US009659453B2

(12) United States Patent
Cuddy et al.

(10) Patent No.: US 9,659,453 B2
(45) Date of Patent: May 23, 2017

(54) GAMING SYSTEM HAVING MULTIPLE PROGRESSIVE AWARDS AND A BONUS GAME AVAILABLE IN A BASE GAME OPERABLE UPON A WAGER

(71) Applicant: IGT, Las Vegas, NV (US)

(72) Inventors: Ryan W. Cuddy, Reno, NV (US); Eric Satterlie, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 14/660,624

(22) Filed: Mar. 17, 2015

(65) Prior Publication Data

US 2015/0187182 A1 Jul. 2, 2015

Related U.S. Application Data

(62) Division of application No. 11/937,363, filed on Nov. 8, 2007, now Pat. No. 8,986,111.

(51) Int. Cl.
*G07F 17/32* (2006.01)

(52) U.S. Cl.
CPC ..... *G07F 17/3258* (2013.01); *G07F 17/32* (2013.01)

(58) Field of Classification Search
CPC ..... G07F 17/3225; G07F 17/3227; G07F 17/3232; G07F 17/3234; G07F 17/3244;
(Continued)

(56) References Cited

U.S. PATENT DOCUMENTS 4,836,553 A * 6/1989 Suttle ..... A63F 1/00 273/274
5,283,734 A 2/1994 Von Kohorn et al.
(Continued)

FOREIGN PATENT DOCUMENTS

EP 1 785 957 A1 5/2007
WO WO 03 063019 A1 7/2003
(Continued)

OTHER PUBLICATIONS

Adders & Ladders Brochure by Barcrest, available Jul. 2001.
(Continued)

*Primary Examiner* — David L Lewis
*Assistant Examiner* — Matthew D. Hoel
(74) *Attorney, Agent, or Firm* — Neal, Gerber & Eisenberg LLP

(57) ABSTRACT

A gaming system and method disclosed herein enable a plurality of players to play for and attempt to win at least one progressive award and a bonus game. The gaming system includes a central controller in communication with a plurality of gaming machines. The central controller maintains a plurality of progressive awards associated with the gaming machines. Each gaming machine includes a primary game operable upon a wager placed by a player. Upon a determination that a designated one of the progressive awards will be provided, based on at least one play of the primary games, the central controller causes one of the gaming machines to provide the designated progressive award to the player of such gaming machine. Each gaming machine is also associated with a bonus game operable upon a triggering event in the primary game.

8 Claims, 16 Drawing Sheets

(58) Field of Classification Search
CPC .. G07F 17/3272; G07F 17/32; G07F 17/3258; G07F 17/3223
See application file for complete search history.

(56) References Cited

U.S. PATENT DOCUMENTS 5,401,023 A 3/1995 Wood
5,482,289 A * 1/1996 Weingardt ..... A63F 3/0645 273/269
5,511,781 A 4/1996 Wood
5,647,798 A * 7/1997 Falciglia ..... G07F 17/34 273/138.2
5,655,961 A * 8/1997 Acres ..... G07F 17/32 463/25
5,713,795 A 2/1998 Von Kohorn
5,788,573 A * 8/1998 Baerlocher ..... G07F 17/32 273/138.2
5,833,537 A 11/1998 Barrie
5,833,538 A 11/1998 Weiss
5,885,158 A 3/1999 Torango et al.
5,980,384 A * 11/1999 Barrie ..... G07F 17/3265 273/138.1
5,997,401 A 12/1999 Crawford
6,053,813 A 4/2000 Mathis
6,059,659 A 5/2000 Busch et al.
6,203,430 B1 3/2001 Walker et al.
6,270,409 B1 8/2001 Shuster
6,270,412 B1 8/2001 Crawford et al.
6,302,793 B1 * 10/2001 Fertitta, III ..... G07F 17/32 463/25
6,312,334 B1 11/2001 Yoseloff
6,319,125 B1 * 11/2001 Acres ..... G07F 17/32 463/25
6,364,765 B1 4/2002 Walker et al.
6,413,161 B1 7/2002 Baerlocher et al.
6,435,511 B1 8/2002 Vancura et al.
6,461,241 B1 10/2002 Webb et al.
6,471,208 B2 10/2002 Yoseloff et al.
6,569,013 B1 5/2003 Taylor
6,602,137 B2 8/2003 Kaminkow et al.
6,607,428 B2 8/2003 Tolles
6,632,139 B1 10/2003 Baerlocher
6,634,943 B1 10/2003 Baerlocher
6,659,461 B2 12/2003 Yoseloff et al.
6,663,489 B2 12/2003 Baerlocher
6,682,419 B2 1/2004 Webb et al.
6,682,420 B2 1/2004 Webb et al.
6,688,598 B1 2/2004 Hsi
6,692,353 B2 2/2004 Walker et al.
6,699,122 B1 3/2004 Osawa
6,726,563 B1 4/2004 Baerlocher et al.
6,773,345 B2 8/2004 Walker et al.
6,776,714 B2 8/2004 Ungaro et al.
6,796,899 B2 9/2004 Baerlocher
6,796,900 B2 9/2004 Baerlocher et al.
6,796,902 B2 9/2004 Baerlocher et al.
6,817,944 B2 11/2004 Kaminkow et al.
6,843,724 B2 1/2005 Walker et al.
6,857,958 B2 2/2005 Osawa
6,875,108 B1 4/2005 Hughs-Baird
6,884,165 B2 4/2005 Baerlocher
6,929,952 B2 8/2005 Baerlocher
6,955,600 B2 10/2005 Glavich et al.
6,958,013 B2 10/2005 Miereau et al.
6,979,263 B2 12/2005 Baerlocher et al.
6,991,544 B2 1/2006 Soltys et al.
7,004,835 B2 2/2006 Baerlocher
7,033,270 B2 4/2006 Baerlocher et al.
7,056,214 B2 6/2006 Miereau et al.
7,059,965 B2 6/2006 Jackson
7,104,888 B2 9/2006 Miereau et al.
7,179,167 B2 2/2007 Dekeller
7,192,346 B2 3/2007 Mathis
7,219,071 B2 5/2007 Gallagher
7,235,011 B2 6/2007 Randall et al.
7,238,110 B2 7/2007 Glavich et al.
7,246,799 B2 7/2007 Snow
7,255,644 B2 8/2007 Duhamel
7,294,054 B2 11/2007 Schugar et al.
7,297,059 B2 11/2007 Vancura et al.
7,326,109 B2 2/2008 Baerlocher
7,338,367 B2 3/2008 Kaminkow et al.
7,338,369 B2 3/2008 Miereau et al.
7,351,145 B1 4/2008 Ornstein et al.
7,357,715 B2 4/2008 Kane
7,393,280 B2 7/2008 Cannon
7,419,430 B1 9/2008 Joshi et al.
7,427,233 B2 9/2008 Walker et al.
7,427,234 B2 9/2008 Soltys et al.
7,431,645 B2 10/2008 Han et al.
7,568,973 B2 * 8/2009 Iddings ..... G07F 17/32 463/25
7,585,223 B2 * 9/2009 Iddings ..... G07F 17/32 463/27
7,607,976 B2 * 10/2009 Baerlocher ..... G07F 17/32 463/16
7,690,977 B2 * 4/2010 Cuddy ..... G07F 17/32 463/16
2001/0028147 A1 10/2001 Ornstein et al.
2002/0183105 A1 12/2002 Cannon et al.
2002/0195773 A1 12/2002 Dunn
2003/0027622 A1 2/2003 Osawa
2003/0042679 A1 3/2003 Snow
2003/0060273 A1 3/2003 Kaminkow et al.
2003/0064793 A1 4/2003 Baerlocher et al.
2003/0085514 A1 5/2003 Yoseloff et al.
2003/0148808 A1 8/2003 Price
2003/0157978 A1 8/2003 Englman
2003/0207713 A1 11/2003 Taylor
2004/0002377 A1 1/2004 Staw et al.
2004/0067790 A1 4/2004 Peterson et al.
2004/0116179 A1 6/2004 Nicely et al.
2004/0185933 A1 9/2004 Nicely
2004/0209663 A1 10/2004 Webb et al.
2005/0003880 A1 1/2005 Englman et al.
2005/0026673 A1 2/2005 Paulsen et al.
2005/0033461 A1 2/2005 Gerrard et al.
2005/0043082 A1 2/2005 Peterson et al.
2005/0054434 A1 3/2005 Baerlocher et al.
2005/0059467 A1 3/2005 Saffari et al.
2005/0070353 A1 3/2005 Webb et al.
2005/0075163 A1 4/2005 Cuddy et al.
2005/0079908 A1 4/2005 Pacey
2005/0159200 A1 7/2005 Nicely et al.
2005/0181866 A1 8/2005 Baerlocher
2005/0215314 A1 9/2005 Schneider et al.
2005/0215316 A1 9/2005 Rowe et al.
2005/0261055 A1 11/2005 Casey et al.
2005/0282626 A1 12/2005 Manfedi et al.
2006/0035694 A1 2/2006 Fuller
2006/0040723 A1 2/2006 Baerlocher et al.
2006/0040730 A1 2/2006 Walker et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0052161 A1 3/2006 Soukup et al.
2006/0052162 A1 3/2006 Soukup et al.
2006/0068893 A1 3/2006 Jaffe et al.
2006/0068899 A1 3/2006 White et al.
2006/0079309 A1 4/2006 Walker et al.
2006/0084495 A1 4/2006 Jaffe et al.
2006/0089195 A1 4/2006 Walker et al.
2006/0111164 A1 5/2006 Hornik et al.
2006/0121972 A1 6/2006 Walker et al.
2006/0148549 A1 7/2006 Walker et al.
2006/0148554 A1 7/2006 Hornik et al.
2006/0154722 A1 7/2006 Walker et al.
2006/0160614 A1 7/2006 Walker et al.
2006/0160625 A1 7/2006 Englman et al.
2006/0178203 A1 8/2006 Hughes et al.
2006/0183535 A1 8/2006 Marks et al.
2006/0183536 A1 8/2006 Gagner et al.
2006/0183538 A1 8/2006 Michaelson et al.

(56) References Cited

U.S. PATENT DOCUMENTS

| | | | |
|---|---|---|---|
| 2006/0189376 | A1 | 8/2006 | Hornik et al. |
| 2006/0189377 | A1 | 8/2006 | Gomez et al. |
| 2006/0211484 | A1 | 9/2006 | Hornik et al. |
| 2006/0247032 | A1 | 11/2006 | Walker et al. |
| 2006/0247033 | A1 | 11/2006 | Walker et al. |
| 2006/0248025 | A1 | 11/2006 | Walker et al. |
| 2006/0252511 | A1 | 11/2006 | Walker et al. |
| 2006/0252512 | A1 | 11/2006 | Walker et al. |
| 2006/0264257 | A1 | 11/2006 | Jaffe et al. |
| 2006/0279044 | A1 | 12/2006 | Pacey |
| 2006/0287035 | A1 | 12/2006 | Walker et al. |
| 2006/0287043 | A1 | 12/2006 | Englman et al. |
| 2006/0287054 | A1 | 12/2006 | Walker et al. |
| 2006/0287068 | A1 | 12/2006 | Walker et al. |
| 2007/0054732 | A1 | 3/2007 | Baerlocher |
| 2007/0054733 | A1 | 3/2007 | Baerlocher |
| 2007/0060314 | A1 | 3/2007 | Baerlocher et al. |
| 2007/0060321 | A1 | 3/2007 | Vasquez et al. |
| 2007/0077981 | A1 | 4/2007 | Hungate et al. |
| 2007/0105619 | A1 | 5/2007 | Kniesteadt et al. |
| 2007/0105620 | A1 | 5/2007 | Cuddy et al. |
| 2007/0129128 | A1 | 6/2007 | McClintic |
| 2007/0135193 | A1 | 6/2007 | Nicely |
| 2007/0135204 | A1 | 6/2007 | Nicely |
| 2007/0135214 | A1 | 6/2007 | Walker et al. |
| 2007/0135215 | A1 | 6/2007 | Walker et al. |
| 2007/0155485 | A1 | 7/2007 | Cuddy et al. |
| 2007/0173309 | A1 | 7/2007 | Rigsby |
| 2007/0173310 | A1 | 7/2007 | Walker et al. |
| 2007/0191088 | A1 | 8/2007 | Breckner et al. |
| 2007/0191107 | A1 | 8/2007 | Walker et al. |
| 2007/0208624 | A1 | 9/2007 | Gallagher |
| 2007/0213114 | A1 | 9/2007 | Caspers et al. |
| 2007/0218975 | A1 | 9/2007 | Iddings et al. |
| 2007/0218982 | A1 | 9/2007 | Baerlocher |
| 2007/0222151 | A1 | 9/2007 | Orntein et al. |
| 2007/0222154 | A1 | 9/2007 | Omstein et al. |
| 2007/0222156 | A1 | 9/2007 | Ornstein et al. |
| 2007/0259711 | A1 | 11/2007 | Thomas |
| 2007/0290442 | A1 | 12/2007 | Lemberg |
| 2007/0293308 | A1 | 12/2007 | Jackson et al. |
| 2007/0293311 | A1 | 12/2007 | Walker et al. |
| 2007/0298874 | A1 | 12/2007 | Baerlocher et al. |
| 2007/0298875 | A1 | 12/2007 | Baerlocher et al. |
| 2008/0009335 | A1 | 1/2008 | Walker et al. |
| 2008/0015012 | A1 | 1/2008 | Englman et al. |
| 2008/0020823 | A1 | 1/2008 | Cuddy et al. |
| 2008/0020824 | A1 | 1/2008 | Cuddy et al. |
| 2008/0020832 | A1 | 1/2008 | Iddings et al. |
| 2008/0020833 | A1 | 1/2008 | Baerlocher et al. |
| 2008/0020834 | A1 | 1/2008 | Breckner et al. |
| 2008/0020846 | A1 | 1/2008 | Vasquez et al. |
| 2008/0039191 | A1 | 2/2008 | Cuddy |
| 2008/0076514 | A1 | 3/2008 | Baerlocher et al. |
| 2008/0076515 | A1 | 3/2008 | Baerlocher et al. |
| 2008/0076517 | A1 | 3/2008 | Baerlocher et al. |
| 2008/0076552 | A1 | 3/2008 | Baerlocher et al. |
| 2008/0090651 | A1 | 4/2008 | Baerlocher |
| 2008/0099991 | A1 | 5/2008 | Snow et al. |
| 2008/0102920 | A1 | 5/2008 | Baerlocher |
| 2008/0106037 | A1 | 5/2008 | Smith et al. |
| 2008/0108410 | A1 | 5/2008 | Baerlocher |
| 2008/0108430 | A1 | 5/2008 | Evans |
| 2008/0108431 | A1 | 5/2008 | Cuddy et al. |
| 2008/0113760 | A1 | 5/2008 | Baerlocher |
| 2008/0113779 | A1 | 5/2008 | Cregan |
| 2008/0125211 | A1 | 5/2008 | Plowman |
| 2008/0139274 | A1 | 6/2008 | Baerlocher |
| 2008/0146344 | A1 | 6/2008 | Rowe et al. |
| 2008/0153564 | A1 | 6/2008 | Baerlocher et al. |
| 2008/0182638 | A1 | 7/2008 | Paulsen et al. |
| 2008/0191418 | A1 | 8/2008 | Lutnick et al. |
| 2008/0194312 | A1 | 8/2008 | Nelson et al. |
| 2008/0200237 | A1 | 8/2008 | Cuddy et al. |
| 2008/0227523 | A1 | 9/2008 | Vallejo et al. |
| 2008/0234041 | A1 | 9/2008 | Berman |
| 2008/0248862 | A1 | 10/2008 | Joshi et al. |
| 2008/0248867 | A1 | 10/2008 | Englman et al. |
| 2008/0254883 | A1 | 10/2008 | Patel et al. |
| 2008/0257800 | A1 | 10/2008 | Gagner et al. |
| 2008/0274783 | A1 | 11/2008 | Walker et al. |
| 2008/0274790 | A1 | 11/2008 | Cannon |
| 2008/0287186 | A1 | 11/2008 | Sakuma |
| 2008/0311973 | A1 | 12/2008 | Jaffe |
| 2009/0005165 | A1 | 1/2009 | Arezina et al. |
| 2010/0120489 | A1* | 5/2010 | Meyer ..... G07F 17/32 463/19 |

FOREIGN PATENT DOCUMENTS

| | | | |
|---|---|---|---|
| WO | WO 2006 116426 | A2 | 11/2006 |
| WO | WO 2006 130597 | A2 | 12/2006 |
| WO | WO 2006 130611 | A2 | 12/2006 |
| WO | WO 2007 028108 | A2 | 3/2007 |
| WO | WO 2007 117502 | A2 | 10/2007 |
| WO | WO 2007 123858 | A2 | 11/2007 |
| WO | WO 2007 134364 | A1 | 11/2007 |
| WO | WO 2007 142980 | A2 | 12/2007 |
| WO | WO 2008 021449 | A2 | 2/2008 |
| WO | WO 2008 039374 | A2 | 4/2008 |
| WO | WO 2008 057189 | A2 | 5/2008 |
| WO | WO 2008 057247 | A2 | 5/2008 |
| WO | WO 2008 057356 | A2 | 5/2008 |
| WO | WO 2008 060978 | A2 | 5/2008 |
| WO | WO 2008 063297 | A2 | 5/2008 |
| WO | WO 2008 063394 | A2 | 5/2008 |
| WO | WO 2008 085294 | A1 | 7/2008 |
| WO | WO 2008 106404 | A2 | 9/2008 |
| WO | WO 2008 143790 | A2 | 11/2008 |

OTHER PUBLICATIONS

Andy Capp Article written by Strictly Slots published in Feb. 2002.

Andy Capp Hits the Bullseye as a New Evo™ Video, written by Bally Gaming Systems, published in 2001.

Atronic Description of the Break the Spell as found at: http://www.atronic.com/products/videoslots/breakthespell/content.shtml, visited on Jan. 15, 2001 (1 page).

Bally Live! Special Global Gaming Expo 2002 Issue written by Bally Gaming Systems, published in Fall 2002.

Bally's Cash Encounters found at: http://www.ballygaming.com/gameroom/video/cash_ecounters.asp, visited on Dec. 17, 2001 (1 page).

Big Bang Piggy Banking Advertisement, written by WMS Gaming, Inc., published prior to 2000.

Black Swan Paytable Display written by IGT, published prior to 2001.

Boot Scootin Article written by Strictly Slots/Aristocrat Leisure Industries, PTY Ltd., available prior to Feb. 24, 2003.

Break the Spell Article written by Strictly Slots/Atronic Casino Technology, Ltd., published in Sep. 2000.

Break the Spell Atronic Web Page, published in Jan. 2001.

Break the Spell Brochure, published in 1999.

Cash Chameleon Advertisement written by Aristocrat, published in Apr. 2001.

Cash Encounters Bally Gaming written by Strictly Slots, Apr. 2001.

Cossack Dancer Advertisement written by Olympic Video Gaming, published prior to 2002.

Description of "ROAD HOG" Gaming Device and Advertisement by Barcrest, available Jul. 2001.

Description of Expanding Symbol written by IGT, available in Sep. 1999.

Description of Gaming Machine with Animating Symbols, IGT, prior to Jun. 29, 2000.

Description of Symbol Feature in Australian UFO Gaming Machine, Barcrest, Ltd., on or before the month of Dec. 1995.

Description of Traveling Symbols, written by IGT, available in Sep. 1999.

Double Diamond Line Advertisement written by Bally Gaming Systems, published in 2000.

(56) References Cited

OTHER PUBLICATIONS

Easy Street Advertisements printed on Jan. 15, 2001.
Easy Street Article (Casino Data Systems) by Strictly Slots published 2000.
Elvis Advertisement by IGT, published in 1999.
Enchanted Forest™ Gaming Description from Aristocrat, available in 1994.
Enchanted Unicorn Advertisement written by IGT, published in 2001.
Fishin' Buddies Article published in Strictly Slots/Anchor Games, published in Apr. 2001.
Ghoulish Gamble Advertisement, written by Konami Australia Pty. Ltd., published prior to Sep. 2000.
Goooaall, Bally Gaming, Inc., on or before the month of Dec. 2000.
Happy Camper Advertisement written by IGT, published in 2001.
Introducing the "Smiling Ape" Machine Advertisement (including Joker's Wild Poker description) written by IGT, published prior to 2001.
Jackpot Party Brochures and Articles by WMS Gaming, Inc., published 1998, 1999, 2000.
Joker's Wild Advertisement written by IGT, published prior to 2001.
Little Green Men, Jr. Advertisement written by A.C. Coin and Slot Services Company, published prior to 2002.
Loco Loot Article written by Strictly Slots/Aristocrat Leisure Industries, PTY Ltd., published in May 2002.
Money Mountain Article written by Strictly Slots/Aristocrat Leisure Industries, PTY Ltd., published in Jun. 2002.
Mystery Mine Advertisement written by Konami Australia Pty. Ltd., published prior to Jan. 1999.
Penguin Pays Advertisement written by Aristocrat Incorporated, published in 1998.
Pink Panther Advertisement and Article, written by IGT, published in 2000.
REEL MAGIC™ Gaming Machine Description written by IGT, available in 1986.
Run for Your Money by Barcrest, published in 1998.
Slotopoly Brochure by IGT, published in 1998.
South Park Advertisement written by IGT, available in Sep. 1999.
Spiker the Biker by Barcrest, available Jul. 2001.
*Strictly Slots,* "Break the Spell, Atronic Casino Technologies," Sep. 2000, (1 page).
The Basics of Winning Video Poker (Chapter VI Deuces Wild & Chapter VII Jokers Wild) written by J. Edward Allen, published in 1990.
Wild Streak Advertisement written by WMS Gaming, Inc., published Mar. 2001.
Winning Streak Web Site Printout by WMS Gaming, Inc. printed Mar. 21, 2001.
Your Real Key to Gaming Success Advertisement (including Roll Over Beethoven and Wild Fortune) written by Olympic Video Gaming, published prior to May 10, 2002.

* cited by examiner

FIG. 3

| AWARD 100 | GAME EVENT 106 | PREDETERMINED QUANTITY OF OCCURRENCES 108 | INITIAL VALUE 102 | INCREMENT 104 |
|---|---|---|---|---|
| LEVEL 1 | FIVE OF A KIND FOR SYMBOL A | 5 | $10,000 | 0.20% |
| LEVEL 2 | FIVE OF A KIND FOR SYMBOL B | 5 | $7,500 | 0.25% |
| LEVEL 3 | FIVE OF A KIND FOR SYMBOL C | 5 | $5,000 | 0.30% |
| LEVEL 4 | FIVE OF A KIND FOR SYMBOL D | 5 | $4,000 | 0.40% |
| LEVEL 5 | FIVE OF A KIND FOR SYMBOL E | 5 | $3,000 | 0.50% |
| LEVEL 6 | ACE | 5 | $2,500 | 0.60% |
| LEVEL 7 | RE-TRIGGER SYMBOLS | 5 | $2,000 | 0.75% |
| LEVEL 8 | SCATTERED WILD SYMBOLS | 200 | $500 | 1.50% |
| FREE BONUS GAME | BONUS SYMBOLS | 5 | | |

FIG. 4

| AWARD 100 | GAME EVENT 106 | PREDETERMINED QUANTITY OF OCCURRENCES 108 | CURRENT VALUE 110 | ACCUMULATED QUANTITIES (PLAYER A) 112a | ACCUMULATED QUANTITIES (PLAYER A) 112a |
|---|---|---|---|---|---|
| LEVEL 1 | FIVE OF A KIND FOR SYMBOL A | 5 | $10,040 | 3 | 2 |
| LEVEL 2 | FIVE OF A KIND FOR SYMBOL B | 5 | $7,550 | 2 | 0 |
| LEVEL 3 | FIVE OF A KIND FOR SYMBOL C | 5 | $5,060 | 4 | 1 |
| LEVEL 4 | FIVE OF A KIND FOR SYMBOL D | 5 | $4,080 | 1 | 4 |
| LEVEL 5 | FIVE OF A KIND FOR SYMBOL E | 5 | $3,100 | 3 | 3 |
| LEVEL 6 | ACE | 5 | $2,620 | 2 | 1 |
| LEVEL 7 | RE-TRIGGER SYMBOLS | 5 | $2,150 | 4 | 2 |
| LEVEL 8 | SCATTERED WILD SYMBOLS | 200 | $800 | 182 | 122 |
| FREE BONUS GAME | BONUS SYMBOLS | 5 | | 3 | 4 |

FIG. 7B

408

ACCUMULATED GAME EVENT METER

ACCUMULATE 5 A-A-A-A-A COMBINATIONS TO WIN THE LEVEL 1 PROGRESSIVE AWARD CURRENTLY VALUED AT $10,040!

ACCUMULATE 5 B-B-B-B-B COMBINATIONS TO WIN THE LEVEL 2 PROGRESSIVE AWARD CURRENTLY VALUED AT $7,550!

ACCUMULATE 5 C-C-C-C-C COMBINATIONS TO WIN THE LEVEL 3 PROGRESSIVE AWARD CURRENTLY VALUED AT $5,060!

ACCUMULATE 5 D-D-D-D-D COMBINATIONS TO WIN THE LEVEL 4 PROGRESSIVE AWARD CURRENTLY VALUED AT $4,080!

ACCUMULATE 5 E-E-E-E-E COMBINATIONS TO WIN THE LEVEL 5 PROGRESSIVE AWARD CURRENTLY VALUED AT $3,100!

ACCUMULATE 5 ACE SYMBOLS TO WIN THE LEVEL 6 PROGRESSIVE AWARD CURRENTLY VALUED AT $2,620!

ACCUMULATE 5 RE-TRIGGER SYMBOLS TO WIN THE LEVEL 7 PROGRESSIVE AWARD CURRENTLY VALUED AT $2,150!

ACCUMULATE 200 SCATTERED WILD SYMBOLS TO WIN THE LEVEL 8 AWARD CURRENTLY VALUED AT $800!

ACCUMULATE 5 BONUS SYMBOLS TO WIN AN OPPORTUNITY TO PLAY A BONUS GAME!

GAMING SYSTEM HAVING MULTIPLE PROGRESSIVE AWARDS AND A BONUS GAME AVAILABLE IN A BASE GAME OPERABLE UPON A WAGER

PRIORITY CLAIM

This application is a divisional of, claims priority to and the benefit of U.S. patent application Ser. No. 11/937,363, filed on Nov. 8, 2007, the entire contents of which is incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (i.e., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game enables the player to make a wager on each payline in a single play of the primary game. Slot games with 1, 3, 5, 9, 15 and 25 lines are widely commercially available. Thus, it is known that a gaming machine, such as a slot game, enables players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. It should be appreciated that different players play at substantially different wagering amounts or levels and at substantially different rates of play.

Secondary or bonus games are also known in gaming machines. These secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game of the gaming machine. For instance, a bonus symbol occurring on a payline on the third reel of a three reel slot machine may trigger the secondary bonus game on that gaming device. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Progressive awards associated with gaming machines are also known. In one form, a progressive award is an award amount which includes an initial amount funded by a casino and an additional amount funded through a portion of each wager made on the progressive gaming machine. For example, 0.1% of each wager placed on the primary game of the gaming machine may be allocated to the progressive award or progressive award fund or pool. The progressive award grows in value as more players play the gaming machine and more portions of the players' wagers are allocated to the progressive award. When a player obtains a winning symbol or symbol combination associated with the progressive award, the accumulated progressive award is provided to the player. After the progressive award is provided to the player, the amount of the next progressive award is reset to the initial value and a portion of each subsequent wager is allocated to the next progressive award.

A progressive award may be associated with or otherwise dedicated to a single or stand-alone gaming machine. Alternatively, a progressive award may be associated with or otherwise dedicated to multiple gaming machines which each contribute a portion of wagers placed at such gaming machine(s) to the progressive award. The multiple gaming machines may be in the same bank of gaming machines, in the same casino or gaming establishment (usually through a local area network ("LAN")) or in two or more different casinos or gaming establishments (usually through a wide area network ("WAN")). Such progressive awards are played for by one or more gaming devices in the same gaming establishment sometimes called local area progressives ("LAP") and such progressive awards played for by a plurality of gaming devices at a plurality of different gaming establishments are sometimes called wide area progressives ("WAP"). Moreover, a gaming machine or bank of gaming machines may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

Typically, players win progressive awards in MLP progressive configurations after a single triggering event occurs in the primary game (such as a single symbol combination). Alternatively, players win progressive awards in MLP progressive configurations based on a mystery event (such as a random event independent of the primary game). Such MLP progressive awards are popular amongst players, however, known MLP configurations do not enable a player to win an MLP progressive award by accumulating a plurality of symbols or symbol combinations through one or more plays of a primary game.

There is a continuing need to provide new and different gaming machines and gaming systems as well as new and different ways to provide awards to players including progressive awards.

SUMMARY

One embodiment of the gaming system and method disclosed herein enables a plurality of players to each play for or try to win one or more progressive awards and bonus awards in plays of primary games displayable by gaming machines in the gaming system. The gaming system includes a plurality of gaming machines that each include a primary game operable upon placement of a wager and a controller configured to operate with the gaming machines. The gaming system accumulates a quantity of game events which occur in plays of the primary games for a plurality of players. If the accumulated events reach a first designated level or quantity, the gaming system provides a bonus award to one of the players. If the accumulated events reach a second designated level or quantity, the gaming system provides a progressive award or one of a plurality of different progressive awards to one of the players. In various embodiments, the players are each simultaneously trying to achieve designated levels or quantities of designated game events to earn different awards and particularly bonus awards and one or more levels of multi-level progressive awards.

In one embodiment, the controller is configured to operate with the gaming machines to provide both (i) one of a plurality of progressive awards, and (ii) a bonus game to a player based on separate triggering events which can occur in the primary games. In this embodiment, one of the gaming machines provides the bonus game and the controller maintains and provides the progressive awards.

In one embodiment, each of the progressive awards is associated with a predetermined quantity of designated game events which can occur in the primary games. One example of such game events includes a designated symbol or symbol combination. The gaming system enables each player to win one of the progressive awards by accumulating one of the predetermined quantities of designated symbols or symbol combinations in the player's account. The gaming system enables the players to compete with one another to win the progressive awards, which each increment in value for each play of the primary games. For example, if the gaming system accumulates the predetermined quantity of designated symbols or symbol combinations associated with a first progressive award for two players in individual accounts, the gaming system provides the first progressive award (at an incremented value) to whichever player is first able to accumulate the predetermined quantity of designated symbols or symbol combinations in the player's account. Once the first progressive award (at the incremented value) is awarded, the first progressive award is reset to a base value. In this example, the player who was second able to accumulate the predetermined quantity of designated symbols or symbols combinations in the player's account is provided the first progressive award (at the base value). The gaming system and method disclosed herein enable a plurality of players to each win the same progressive award and provide an incentive (i.e., a progressive award with an incremented value) to the player who first accumulates the predetermined quantity of symbols or symbol combinations. The gaming system also enables each of the players to win an opportunity to play a bonus game by accumulating a predetermined quantity of symbols or symbol combinations in the player's account.

In one embodiment, the gaming system includes a plurality of progressive awards and a bonus game each associated with the primary games provided by each of the gaming machines of the gaming system. The gaming system enables the players of the gaming machines to attempt to collect or accumulate designated symbols or symbol combinations which occur in plays of the primary games. Each one of the progressive awards and the bonus game are associated with: (i) different predetermined quantities of a designated symbol or symbol combination which occur in the primary game, or (ii) a predetermined quantity of different designated symbols or symbol combinations which occur in the primary game. The gaming system tracks each occurrence of the designated symbols or symbol combinations in the plays of the primary games for each individual player. In one embodiment, if one of the designated symbols or symbol combinations occurs in a play of the primary game, the gaming system collects or accumulates the quantity of such occurrences for each player in the player's account. Once the controller determines that one of the player accounts has increased or accumulated to the predetermined quantity of designated symbols or symbol combinations associated with one of the progressive awards, the gaming system provides such progressive award to the player. Similarly, once the controller determines that one of the player accounts has increased or accumulated to the predetermined quantity of designated symbols or symbol combinations associated with the bonus game, the gaming system provides an opportunity to play the bonus game to the player.

In one embodiment, each of the bonus games is associated with a designated quantity of the game events, such as one or more bonus symbols. For example, the bonus game is triggered upon an accumulation of five bonus symbols in plays of the primary games by the same player. In this example, the controller is programmed to track the quantity of bonus symbols that occur in the primary games played by each player at the gaming machines. The controller and/or each individual gaming machine is programmed to collect or accumulate each occurrence of the bonus symbol in a player account for each individual player. If one of the player accounts accumulates to the designated quantity of the bonus symbols, the controller and/or the gaming machine being played by the player associated with that player account cause the bonus game to be provided to the player. In one embodiment, the controller is programmed to enable the player to play the bonus game at a selected time (e.g., immediately, at a later time, or during a different gaming session). In one embodiment, the bonus game is triggered upon an accumulation of a designated quantity of bonus symbols in plays of another bonus game by the same player.

In one embodiment, the gaming system tracks each occurrence of designated symbols or symbol combinations in the plays of the primary games for each player account based on the players' wagers. In one embodiment, the gaming system tracks or counts each occurrence of a designated symbol or symbol combination as a multiple of each player's wager per payline in plays of the primary game. For example, if one of the players wagers three monetary units per line, the gaming system tracks or counts each designated symbol or symbol combination that occurs in the primary games as three occurrences of that designated symbol or symbol combination for that player's account. In this instance, the controller counts or accumulates one occurrence of the designated symbol or symbol combination as three occurrences for that player's account. For example, if one of the players wagers three monetary units per payline, and the primary game played by that player generates a symbol combination of A-A-A-A-A, the controller is programmed to increase the quantity of occurrences for the A-A-A-A-A symbol combination by three in the player's account. This enables the players of the gaming machines in the gaming system to collect or accumulate the designated quantity of symbols or symbol combinations faster if the players wager higher amounts per payline for the primary games.

In one embodiment, the gaming system includes a plurality of gaming machines which offer different primary games to players. In this embodiment, the gaming system adds to, or otherwise replaces, the symbol set associated with each primary game with a uniform symbol set across all of the primary games. The uniform symbol set associates designated symbols in each of the primary games with a number of secondary symbol characteristics, such as a sub-symbol. The sub-symbols or combinations of such sub-symbols must be accumulated to provide one of the players with one of the progressive awards or the bonus game. For example, a first progressive award is associated with five occurrences of the A-A-A-A-A sub-symbol combination and a second progressive award is associated with five occurrences of the B-B-B-B-B sub-symbol combination. If the primary game generates an outcome of $7_A$-$Bell_A$-$Bell_A$-$Bar_A$-$Lemon_A$ on a payline wagered on by that player, the sub-symbol combination A-A-A-A-A is accumulated. In this example, if a player accumulates the sub-symbol combination A-A-A-A-A five times during one or more plays of the primary game, the player is provided a first progressive award. If the player accumulates the sub-symbol combination B-B-B-B-B five times during one or more plays of the primary game, the player is provided the second progressive award. In this example, sub-symbols of the uniform symbol set form the combinations which are tracked and accumulated in player accounts by the controller of the gaming system.

In one embodiment, the gaming system includes a plurality of gaming machines in communication with a central controller. Each gaming machine includes a primary game operable upon a wager placed by a player. The controller is programmed to maintain a plurality of progressive awards. In one embodiment, the controller maintains the progressive awards across a plurality of games (which may be the same or different) at a plurality of the gaming machines. This enables the gaming system to increment values of the progressive awards at a faster rate and generates competition between players to win one of the progressive awards.

In one embodiment, one of the progressive awards is associated with a designated quantity of A-A-A-A-A combinations. That is, if a player collects or accumulates the designated quantity of A-A-A-A-A combinations in the player's account, the gaming system will provide that player with the progressive award. For example, the designated quantity of A-A-A-A-A combinations associated with a first one of the progressive awards is five. That is, once a player's account accumulates five A-A-A-A-A combinations, the gaming system provides the first progressive award to the player associated with that player account.

In another embodiment, one of the progressive awards is associated with a designated quantity of A-A-A-A-A combinations. That is, if a gaming machine played by a player tracks or accumulates the designated quantity of A-A-A-A-A combinations for the player, the gaming machine will provide (or will be instructed by the controller to provide) that player with the progressive award. In one such embodiment, each gaming machine is associated with a meter or other tracking hardware and/or software configured to track and accumulate any designated symbols or symbol combinations which occur at that gaming machine. In one such embodiment, each gaming machine tracks and accumulates the designated symbols or symbol combinations. For example, the designated symbol combination of A-A-A-A-A is associated with a first one of the progressive awards and a player must accumulate the symbol combination of A-A-A-A-A five times during plays of the game to be provided the first progressive award. The gaming machine tracks any symbols or symbol combinations that occur in plays of a game. That is, once the gaming machine tracks or accumulates five A-A-A-A-A combinations, the first progressive award is provided to the player at the gaming machine.

In one embodiment, the controller is programmed to operate with a plurality of different gaming machines in a server-based environment. In one such embodiment, a plurality of the gaming machines include a plurality of different primary games operable upon a wager placed by a player. Each of the different primary games can have different symbols or symbol combinations which can occur in a play of the primary game. The controller is programmed to associate symbols or symbol combinations having a same, or substantially the same, probability of occurring in a play of the different primary games. For example, the controller associates the symbol combination of a Royal Flush in a first primary game with the symbol combination of A-A-A-A-A in a second primary game. In this example, the symbol combinations of Royal Flush and A-A-A-A-A are associated with a same probability (or different, but substantially equal, probabilities) and a same award (or different, but substantially equal, awards). In this embodiment, the controller tracks a quantity of the Royal Flush symbol combinations that occur in plays of the first primary game and tracks the A-A-A-A-A symbol combinations that occur in plays of the second primary game. When the tracked quantity of the Royal Flush symbol combinations and/or the A-A-A-A-A symbol combinations reach a designated level or quantity, the controller causes an award associated with the Royal Flush symbol combinations and/or the A-A-A-A-A symbol combinations to be provided. In this embodiment, the controller enables players at different gaming machines to each play for or try to win one or more progressive awards and bonus awards in plays of the same or different primary games displayable by gaming machines in the gaming system.

In one embodiment, the controller is programmed to operate with a player tracking system to manage each player account. In one such embodiment, the player tracking system manages each player account and maintains any collected or accumulated quantities of designated game events for each player in the player accounts. That is, the player tracking system keeps track of each player's individual progress toward each one of the progressive awards and any bonus games. Players having a player tracking card or other suitable device can access the player tracking system through one of the gaming devices in the gaming system. This enables players to select any of the gaming machines in the gaming system to play for the progressive awards. Additionally, the gaming system enables each of the players to move from gaming machine to gaming machine to play primary games of the player's choice. Tracking each player's individual progress toward each one of the progressive awards and any bonus games also enables the gaming device to enable players to stop and resume play at a later time or during a different gaming session.

One feature of the gaming system disclosed herein is to provide the players of gaming machines in the gaming system an opportunity to select which primary game or gaming machine to play in addition to playing for the plurality of progressive awards maintained by the gaming system.

Another feature of the gaming system disclosed herein is to provide a plurality of progressive awards which increment to higher values and are provided to players relatively often. Such higher progressive awards and faster hits create additional excitement for players and can motivate such players to continue playing the primary game to collect or accumulate more symbols or symbol combinations.

An additional feature of the gaming system disclosed herein is to provide a player-driven progressive award that enables each player to individually enhance their chance of winning one of the progressive awards. For example, a player can play for the progressive award longer to collect or accumulate more symbols or symbol combinations. In another example, a player can wager higher amounts per line to collect or accumulate more symbols or symbol combinations. That is, each player has a direct effect on a probability of winning one of the progressive awards by their play (i.e., the amount of the player's wager, the length of the player's gaming session, and at which time the player chooses to play for the progressive awards).

Another feature of the gaming system is to provide a multi-level award structure in association with a plurality of primary games, wherein the primary games can be the same primary game or different primary games.

Additional features and advantages are described herein, and will be apparent from, the following Detailed Description and the figures.

BRIEF DESCRIPTION OF THE FIGURES

FIG. 3 is a table illustrating an association between a plurality of progressive awards, a bonus game, a plurality of game events in a plurality of primary games, and a predetermined quantity of such game events.

FIG. 4 is a table illustrating an association between a plurality of progressive awards, a bonus game, a plurality of game events in a plurality of primary games, and a tracked or accumulated quantity of such game events for a plurality of players.

FIGS. 7A, 7B, 7C, and 7D are top plan views of a display device of one of the gaming devices of one embodiment of the gaming system disclosed herein illustrating an example play for one player of a primary game at one gaming machine in the gaming system.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
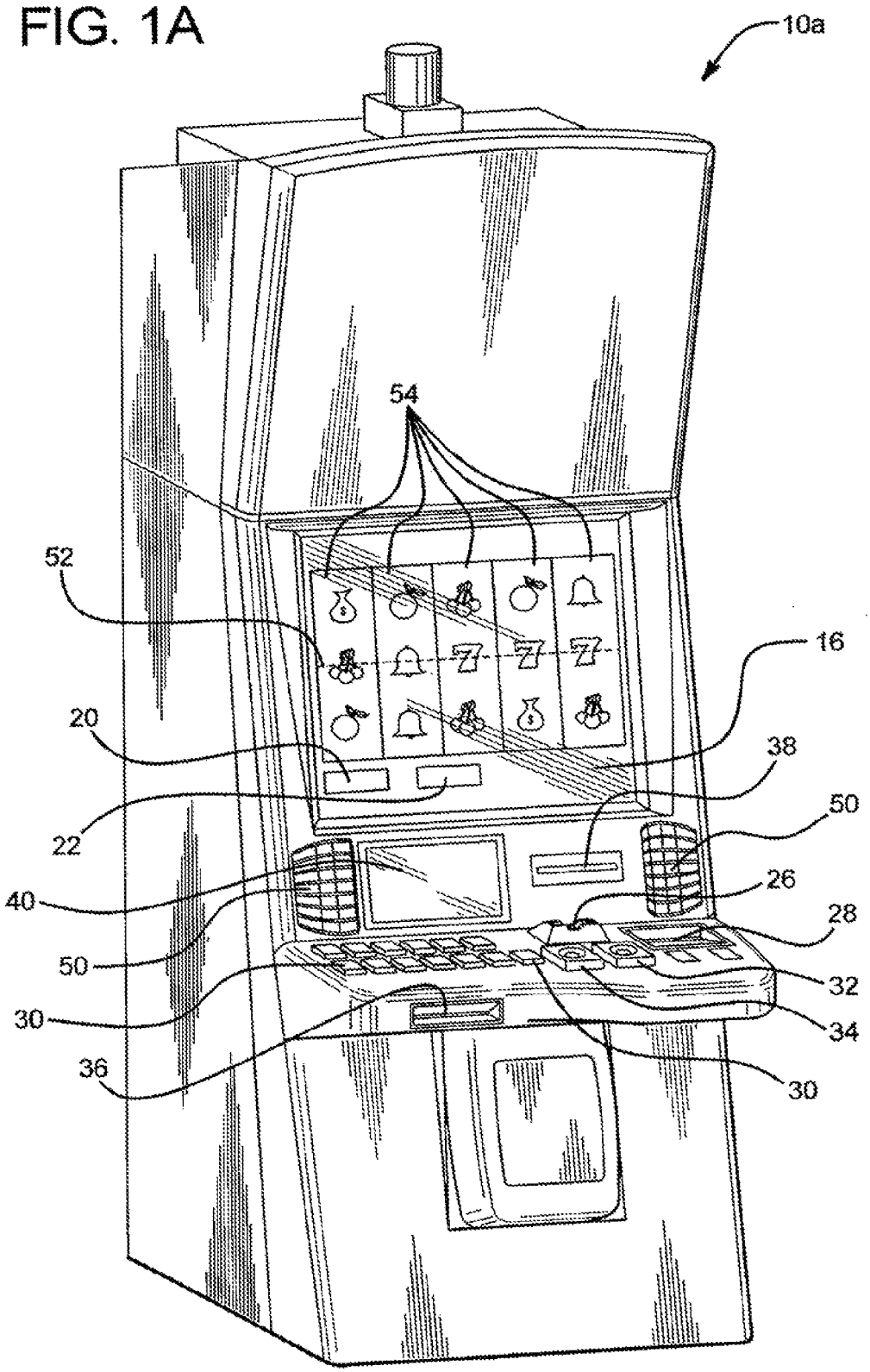
FIG. 1A is a front-side perspective view of one embodiment of the gaming device disclosed herein.
Figure 1B:
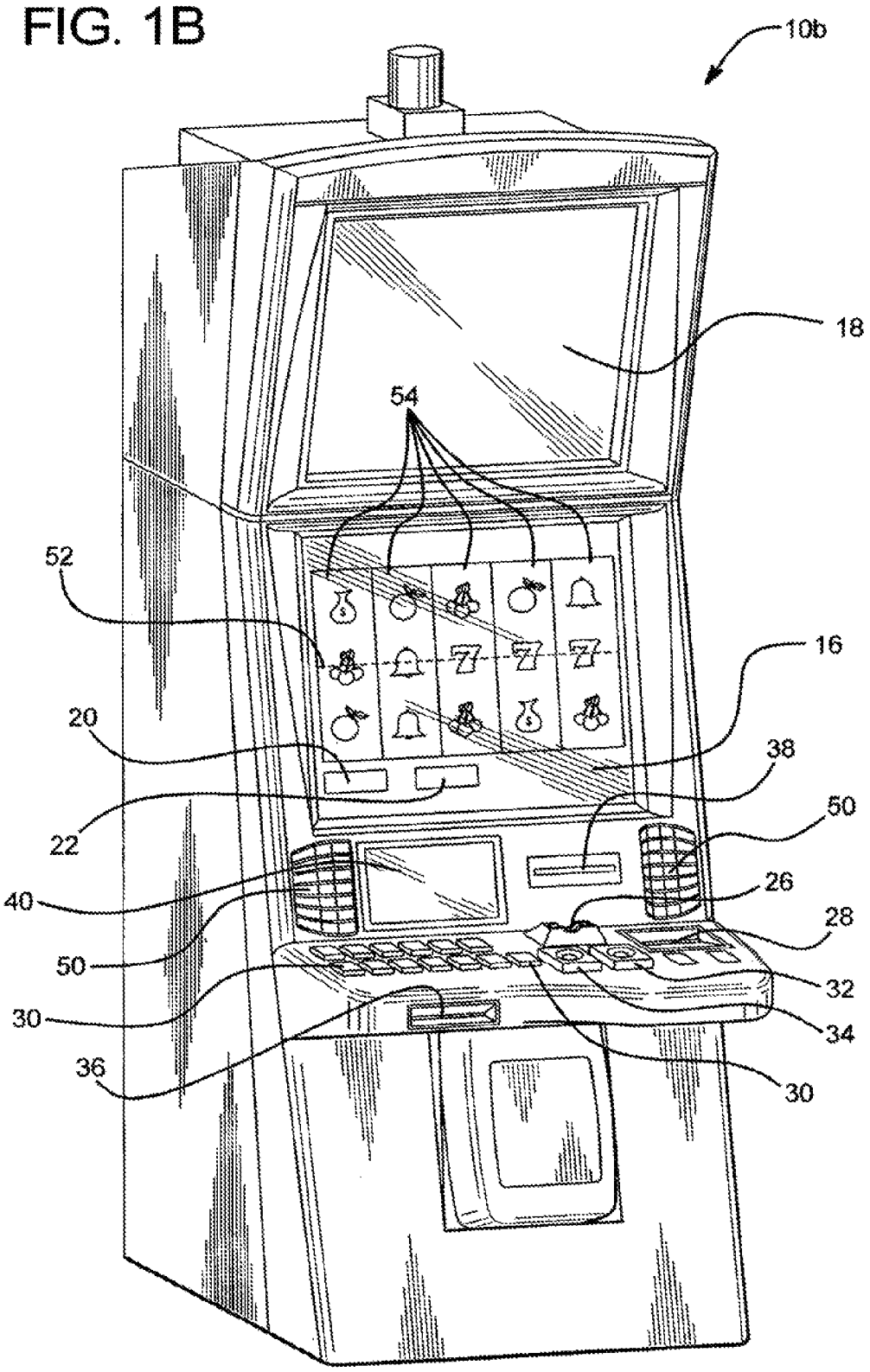
FIG. 1B is a front-side perspective view of another embodiment of the gaming device disclosed herein.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
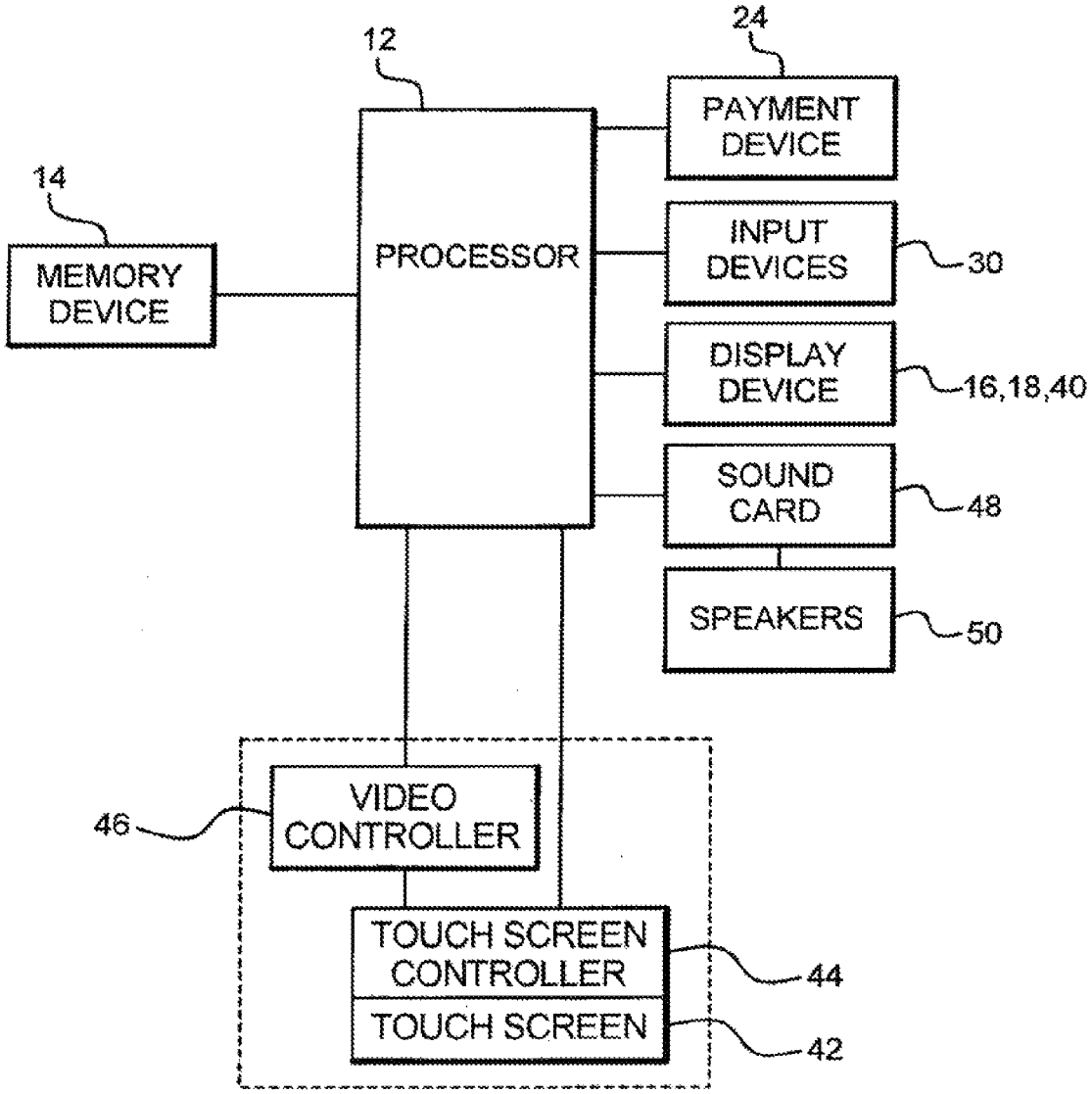
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
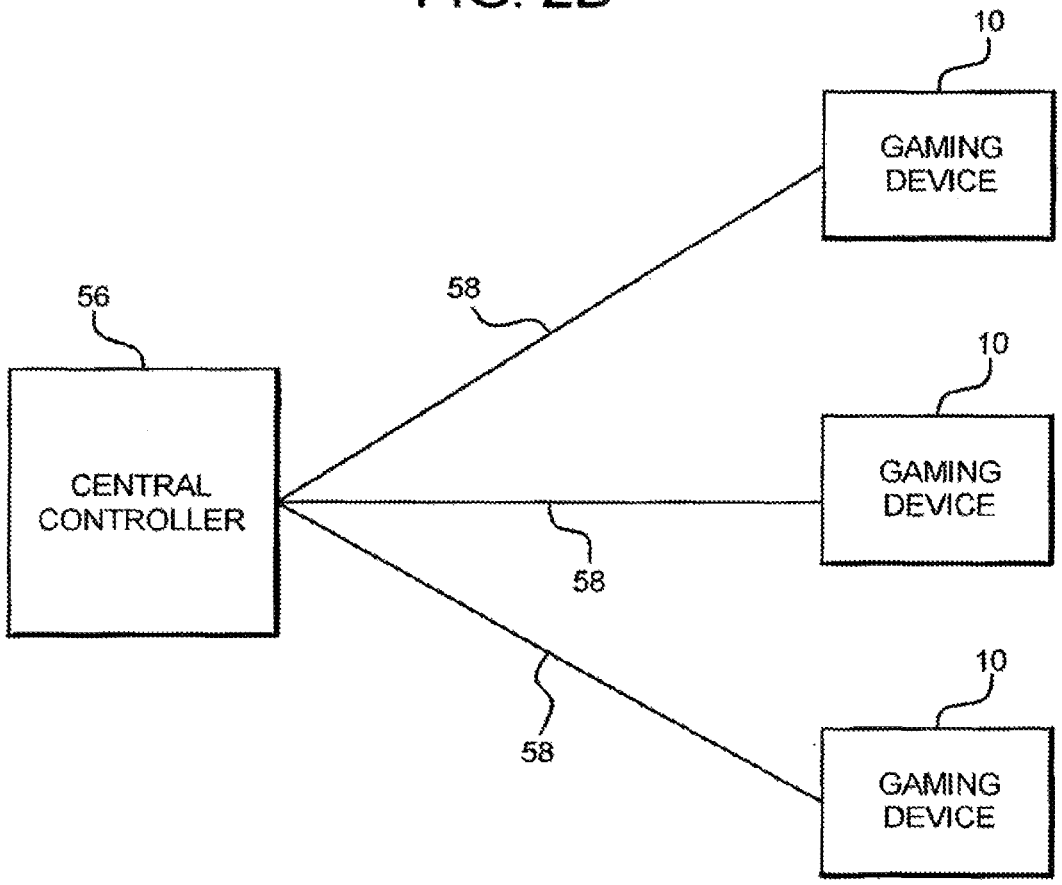
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Progressive Awards

In one embodiment, a plurality of gaming devices at one or more gaming sites are networked to the central server in a progressive configuration, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer serves gaming devices distributed throughout a number of properties (e.g., casinos) at different geographical locations including, for example, different locations within a city or different cities within a state. In one embodiment, a progressive gaming system host site computer serves gaming devices of at least one designated manufacturer distributed throughout one or more properties of a designated casino.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller. In one embodiment, the predetermined requirement includes an accumulation of game events, as will be described in greater detail below.

In one embodiment, a progressive award win is triggered based on an accumulation of one or more game play events, such as a symbol-driven trigger. In another embodiment, a player is provided a progressive award at least partially based on an accumulation of one or more game triggered or symbol triggered events, such as at least partially based on the play of a primary game.

In one embodiment, a plurality of progressive awards are associated with system gaming machines which each contribute portions of wagers placed at such gaming machine(s) to the progressive awards. In one such embodiment, a progressive award may be associated with or otherwise dedicated to a single or stand-alone gaming machine. The multiple gaming machines may be in the same bank of gaming machines, in the same casino or gaming establishment (such as through a LAN) or in two or more different casinos or gaming establishments (such as through a WAN).

In one embodiment, the progressive awards include accumulated value progressive awards in a multi-level progressive award configuration (sometimes referred to herein as an "MLP"). In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

In one embodiment, one or more progressive awards are provided to a player based on a displayed event in a play of a primary game of one of the gaming devices. In one such embodiment, the determination of when to provide such a progressive award is based on a symbol driven event, such as the generation of one or more designated symbols or symbol combinations in a play of the primary game. That is, a player is provided a chance to move up one or more progressive award levels of an MLP, wherein winning different progressive award levels is based on a tracked or accumulated quantity of outcomes which occur in the primary game. In this embodiment, since the chance of winning such progressive awards is randomly determined based on at least one probability calculation, and the progressive awards are funded by the player's wagers, the amount which the progressive awards in the MLP may be incremented to is unlimited and thus may grow to large, desirable levels.

In one embodiment, the gaming system includes a plurality of awards in association with a primary game. The primary game is playable by a plurality of players at a plurality of gaming machines in the gaming system. In one embodiment illustrated in FIGS. 3 and 4, the controller maintains a plurality of awards 100 in a multi-level configuration. The awards 100 include a plurality of progressive awards and at least one bonus game. A plurality of the progressive awards are associated with different award levels and each of the bonus games is associated with a different award level.

Each of the progressive awards has an initial value 102 and an increment value 104. In one embodiment, one or more of the progressive awards start at different initial values 102 such as $10,000, $7,500, $5,000, $4,000, $3,000, $2,500, $2,000, and $500 and increment or increase until provided to a player. The progressive awards accumulate based on the increment value 104, which includes a small percentage (such as 0.20%, 0.25%, 0.30%, 0.40%, 0.50%, 0.60%, 0.75%, and 1.50%) of coin-in or wagered amounts in plays of a primary game. In one embodiment, the percentage that goes to each progressive award is different. For a first award level associated with a progressive award initially valued at $10,000 and incremented at 0.20%, player wagers totaling $20,000 are required for the level 1 progressive award to accumulate to $10,040. At least a fraction of this amount may be funded by the casino using a starting value higher than zero to make the progressive awards attractive even after they are reset. The controller continues to increase the values of the progressive awards until one of the progressive awards is provided to a player.

In one embodiment, one or more of the progressive awards are each funded via a side bet or side wager. In this embodiment, a player must place or wager a side bet to be eligible to win any progressive awards associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

Referring back to FIGS. 3 and 4, each one of the awards 100 is associated with a designated game event 106. Each one of the awards 100 is also associated with a predetermined quantity 108 of occurrences or generations of such designated game events 106. In one embodiment, the game events 106 include designated symbols or symbol combinations. Such designated symbols or symbol combinations include, but are not limited to, game symbols, re-trigger or free spin symbols, wild symbols, and bonus symbols arranged along a payline or in a scatter pay arrangement. In one embodiment, each one of the awards 100 is associated with one or more different quantities of a same game event 106, such as a same symbol or symbol combination. For example, a first progressive award is associated with ten occurrences or generations of an A-A-A-A-A symbol combination and a second progressive award is associated with five occurrences or generations of an A-A-A-A-A symbol combination. In another example, a first progressive award is associated with five occurrences or generations of an A-A-A-A-A symbol combination and also associated with three occurrences or generations of a B-B-B-B-B symbol combination. In this example, a second progressive award is associated with ten occurrences or generations of an A-A-A-A-A symbol combination and also associated with five occurrences or generations of a B-B-B-B-B symbol combination. In another embodiment, each one of the awards is associated with a designated quantity of one or more different game events 106, such as different symbols or symbol combinations. For example, a first progressive award is associated with five occurrences or generations of an A-B-C-D-E symbol combination and a second progressive award is associated with three occurrences or generations of an A-A-A-X-X symbol combination, wherein X represents any symbol which can occur in the play of the primary game. In another example, a first progressive award is associated with five occurrences or generations of an A-A-A-A-A symbol combination and also associated with five occurrences or generations of a B-B-B-B-B symbol combination.

In operation of the gaming system, a plurality of players place wagers to operate plays of the primary game at the gaming machines. A portion (based on the increment rate 104) of each wager funds the progressive awards. As each progressive award is funded, the progressive awards increase from the initial value 102, as seen in FIG. 3, to the current or accumulated value 110, as seen in FIG. 4. The current or accumulated values 110 are based on the increment rates 104 of FIG. 3 and player wagers or coin-in totaling $20,000.

In one embodiment, to account for different gaming devices utilizing different wager denominations, the central server tracks the player's coin-in in any suitable compatible or comparable manner such as credits wagered (i.e., if all of the gaming machines of the gaming system are of the same denomination) or monetary units (e.g., total dollars or other currency) wagered. It should be appreciated that tracking in monetary units accounts for gaming machines having multi-denominations and/or for gaming machines of different denominations and/or gaming machines which accept different currencies. For example, for a player playing a penny gaming device, the central server provides the player with 300 monetary units after the player has wagered 300 coins (i.e., $3) and for a player playing a nickel gaming device, the central server provides the player with 300 monetary units after the player has wagered 60 coins (i.e., $3).

During plays of the primary game, the controller of the gaming system tracks which game events 106 occur in the primary game. In one embodiment, the controller communicates with the gaming machines, at predetermined intervals, to retrieve information relating to which game events 106 occurred in the primary game. In one embodiment, the predetermined interval includes an award event or a winning game event occurs in a play of the primary game at one of the gaming machines. In another embodiment, the predetermined interval includes a player cashing out from or leaving one of the gaming machines.

In one embodiment, each gaming machine is associated with a player-specific game event meter or other tracking hardware or software, which tracks the game events 106 which occur in the primary game. In this embodiment, each meter tracks which game events occur on one gaming device for one player. The controller is configured to communicate with such game event meters to retrieve a tracked quantity of each game event 106 for players at the gaming machines. In one embodiment, each of the gaming machines is configured to operate with an associated player-specific game event meter to track and store a quantity of each game event 106 which occurred or were accumulated in the primary game for the player of that gaming machine.

In one embodiment, such as the embodiment illustrated in FIG. 4, the controller maintains separate tracked quantities 112*a* and 112*b* accumulated by individual players of gaming machines in the gaming system. The controller maintains the tracked or accumulated quantity 112*a* of each game event 106 for a first player (player A) and maintains the tracked or accumulated quantity 112*b* of each game event 106 for a second player (player B). In one embodiment, the controller maintains the tracked or accumulated quantities 112*a* and 112*b* in separate player accounts, as described in greater detail below.

When a first game event 106 (e.g., FIVE OF A KIND FOR SYMBOL A or A-A-A-A-A) occurs in a play of the primary game, the controller increments the tracked quantity 112*a* or 112*b* for the first game event 106 for one of the players (player A or player B). For example, the players (players A and B) are playing the primary game at different gaming machines in the gaming system. If the gaming machine being played by the first player (player A) generates the first game event 106 (e.g., A-A-A-A-A), the controller increments the tracked quantity 112*a* for the first game event 106 for the first player (player A). This process continues for each play of the primary game by each player at gaming machines in the gaming system.

For each designated game event 106 that occurs in the primary game, the controller increments the tracked quantity associated with that game event for one of the players. When the tracked quantity of a designated game event 106 reaches (i.e., is equal to or is greater than) the predetermined quantity of that designated game event 106, the controller provides the associated award 100 to one of the players at the gaming machines in the gaming system. For example, as illustrated in FIGS. 3 and 4, a level 8 progressive award started at its initial value of $500 and has incremented to its current value of $800. The level 8 progressive award is associated with a predetermined quantity (e.g., 200) of a designated game event (e.g., a scattered wild symbol).

The controller maintains separate accounts for first and second players (players A and B). Each account includes tracked or accumulated quantities of the scattered wild symbols for the players. As illustrated in FIG. 4, the controller has incremented the player account associated with the first player (player A) to 182 scattered wild symbols and the controller has incremented the player account associated with the second player (player B) to 122 scattered wild symbols. Since the level 8 progressive award is associated with 200 scattered wild symbols, the first player (player A) must collect or accumulate 18 more scattered wild symbols to be provided the level 8 progressive award, and the second player (player B) must collect or accumulate 78 more scattered wild symbols to be provided the level 8 progressive award.

In one embodiment, the gaming system tracks or counts each occurrence of a designated game event 106 as a multiple of a player's wager per line or payline in the primary game. Continuing with the above example, if the first player (player A) wagers nine monetary units per payline in the primary game, the controller tracks or counts each occurrence or generation of a scattered wild symbol as nine occurrences or generations (e.g., 9 monetary units per payline×1 designated symbol=9 tracked or accumulated occurrences). If the gaming machine being played by the first player (player A) generates one scattered wild symbol in a play of the primary game, the controller increments the player account associated with the first player (player A) from 182 to 191 scattered wild symbols. The player account associated with the first player (player A) increases by 9 tracked or accumulated occurrences for each scattered wild symbol generated in the primary game. In this example, the first player (player A) must collect or accumulate 9 more scattered wild symbols to be provided the level 8 progressive award.

Referring back to the above example, if the gaming machine being played by the first player (player A) generates two scattered wild symbols in a play of the primary game, the controller tracks or counts each occurrence or generation of a scattered wild symbol as nine occurrences or generations (e.g., 9 monetary units per payline×2 designated symbols=18 tracked or accumulated occurrences). In this example, the controller increments the player account associated with the first player (player A) from 182 to 200 scattered wild symbols. In this instance, the controller provides the level 8 progressive award to the first player (player A) and resets the level 8 progressive award to its reset value (e.g., the initial value of $500). The controller enables the players of the gaming machines in the gaming system to collect or accumulate the predetermined or designated quantity of game events associated with one of the awards faster if the players wager higher amounts per payline for the primary games.

In one embodiment, the denomination of the gaming machine being played by the player affects the probability of designated symbols or symbols combinations which occur in the primary games. For example, the central server causes a nickel gaming device to generate a designated game event, such as a designated symbol or symbol combination, more often than a penny gaming device. In this example, the nickel gaming device generates one or more symbols or symbol combinations (e.g., A-A-A-A-A or B-B-B-B-B) five times more often than a penny gaming device. In another example, a dollar gaming device generates one or more symbols or symbol combinations (e.g., A-A-A-A-A or B-B-B-B-B) one hundred times more often than a penny gaming device.

In another embodiment, the denomination of the gaming machine being played by the player affects the availability of designated symbols or symbols combinations which occur in the primary games. For example, the central server enables a nickel gaming device to generate more designated game events, such as designated symbols or symbol combinations, than a penny gaming device. In this example, the nickel gaming device can generate one or more additional symbols or symbol combinations (e.g., Y-Y-Y-Y-Y and Z-Z-Z-Z-Z) than a penny gaming device.

It should be appreciated that the gaming system disclosed herein enables a plurality of players to simultaneously play for and attempt to win a plurality of awards. The above examples illustrate the controller incrementing the player account associated with the first player (player A) from 182 scattered wild symbols to 191 or 200 scattered wild symbols based on the wagers placed by the first player (player A). Such increments occur in a single play of the primary game and are based on the wager placed by the first player (player A). It should be appreciated that the same increments could occur in multiple plays of the primary game over time. For example, if a second player (player B) wagers one monetary unit per payline in nine plays of the primary game, and the gaming machine being played by the second player (player B) generates one scattered wild symbol for each of the nine plays, the controller increments the player account associated with the second player (player B) by nine tracked or accumulated scattered wild symbols (e.g., from 122 to 131 scattered wild symbols).

After the level 8 progressive award is provided to the first player (player A), the amount of the level 8 progressive award is reset to the initial value of $500. A portion of each subsequent wager placed by the first player (player A) is allocated to the reset level 8 progressive award based on the increment rate. The first player (player A) as well as other players (player B and others) can play for and attempt to win the reset progressive award. The gaming system generates a competition or a race between players to win one of the progressive awards at the accumulated value before such progressive awards are reset to the initial values.

In one embodiment, to account for different gaming devices having different payback percentages, the central server adjusts the availability, quantity, and/or probability of designated symbols or symbols combinations which can occur to compensate for the differences in payback percentages. In this embodiment, the central server provides different symbols or symbol combinations having the same or substantially the same probability of occurring at different gaming devices. Such a configuration provides for a gaming system which generates different symbols or symbol combinations at the same or substantially the same probability over a designated period of time. For example, if a first game at a first gaming device is associated with an average expected payback percentage of 85% and a second game at a second gaming device is associated with an average expected payback percentage of 95%, then to normalize the symbols or symbol combinations generated based on game payback percentages, for the same symbol or symbol combination, the player playing the first game at the first gaming device obtains more symbols or symbol combinations than the player playing the second game at the second gaming device. In this example, the first gaming device associated with the average expected payback percentage of 85% generates five A-A-A-A-A combinations over a plurality of plays of the first game and the second gaming device associated with the average expected payback percentage of 95% generates three A-A-A-A-A combinations over a plurality of plays of the second game.

With continued reference to FIG. 4, one of the awards 100 includes a bonus game. In one embodiment the bonus game is separate from the primary game and may include any suitable bonus game, such as an offer and acceptance game, a skill or perceived skill game, a selection game, or a card game. In another embodiment, the bonus game is one or more free plays of the primary game. In the embodiment illustrated in FIG. 4, the bonus game is associated with a designated game event 106, such as a bonus symbol or bonus symbol combination, which can occur in the primary game. In this embodiment, the bonus game is also associated with a predetermined quantity 108 of occurrences or generations of the designated game event 106. In one embodiment, the bonus game may additionally be triggered by other game events in the primary game, or by non-game events such as events which occur independent of the primary game. In one embodiment, the bonus game is triggered upon an accumulation of a designated quantity of bonus symbols in plays of another bonus game by the same player.

When the designated game event 106 (e.g., a bonus symbol) occurs in a play of the primary game, the controller increments the tracked quantity 112*a* or 112*b* for the designated game event 106 for one of the players (player A or player B). For example, the players (players A and B) are playing the primary game at different gaming machines in the gaming system. As illustrated in FIG. 4, the controller has incremented the player accounts associated with the first and second players (players A and B) to the tracked quantities 112*a* and 112*b* for the designated game event 106. The player accounts associated with the first and second players (players A and B) indicate that the first player (player A) has accumulated or collected 3 bonus symbols, while the second player (player B) has accumulated or collected 4 bonus symbols. Since the bonus game is associated with 5 bonus symbols, in the embodiment illustrated in FIG. 4, the first player (player A) must collect or accumulate 2 more bonus symbols to be provided the bonus game, and the second player must collect or accumulate 1 more bonus symbol to be provided the bonus game. If the gaming machine being played by the second player (player B) generates one or more occurrences of the designated game event 106 (e.g., one or more bonus symbols), the controller will cause the gaming device being played by the second player (player B) to provide the second player (player B) the bonus game. In one embodiment, the gaming machine processor provides the bonus game to the second player (player B).

In one embodiment, the controller and/or the gaming machine processor provide the bonus game to the second player (player B) through one of the gaming devices in the gaming system. In one embodiment, the controller and/or the gaming machine processor enable the second player (player B) to play the bonus game at a selected time (e.g., immediately, at a later time, or during a different gaming session). In one embodiment, the controller and/or the gaming machine processor enable the second player (player B) to selectively play the bonus game. For example, the controller and/or the gaming machine processor request input from the player regarding whether or not the player wants to: (i) play the bonus game, or (ii) save the bonus game. If the player selects to play the bonus game, the controller and/or the gaming machine processor provide the bonus game to the player as requested by that player. If the player selects to save the bonus game, the controller maintains the tracked quantity of bonus symbols in the player account associated with the second player (player B).

In another embodiment, the designated game events 106 include different quantities of different game events (e.g., one A-A-A symbol combination or one B-B-B symbol combination) which can occur in a play of a bonus or secondary game. Examples of designated game events 106 include both a Bonus-A-A-A-C symbol combination and a B-A-B-Bonus-B symbol combination. In one such embodiment, the designated game events 106 which occur in the play of the bonus game determines whether the player is provided one of the awards 100.

In one embodiment, the bonus game includes at least one aspect based on the designated game events 106 which occur in the primary game to trigger the bonus game (e.g., three Bonus symbols). For example, in one such embodiment, the aspect includes a number free spins. In this example, different designated game events 106, which occur in the primary game to trigger the bonus game, determine how many free spins are provided to a player for the bonus game. If a first designated game event 106 occurs in the primary game to trigger the bonus game (e.g., Bonus-Bonus-Bonus-A-A), the player is provided with three free spins and if a second designated game event 106 occurs in the primary game to trigger the bonus game (e.g., Bonus-Bonus-Bonus-B-B), the player is provided with five free spins. By triggering the bonus game with the second designated game event 106 instead of the first designated game event 106, the player is provided with a greater number of free spins and thus, is more likely to win an award in the bonus game. It should be appreciated that different game events 106 can be associated with different aspects (e.g., free spins, selections, multipliers, or other suitable aspects) or different quantities of such aspects.

In one embodiment, the bonus game is associated with a multiplier based on the designated game event 106 (or a combination of such events) that occurred in the primary game to trigger the bonus game. For example, if a player accumulates ten B-B-B-B-B symbol combinations, the controller and/or the gaming machine processor request input from the player regarding whether or not the player wants to: (i) play the bonus game at a first multiplier, or (ii) attempt to accumulate ten additional B-B-B-B-B symbol combinations to play the bonus game at a second, different (e.g., higher) multiplier.

Referring back to FIGS. 3 and 4, by maintaining or storing the tracked quantity of game events 106 in player accounts, the controller keeps track of each player's individual progress toward each one of the progressive awards and any bonus games. In one embodiment, the controller causes display devices associated with the gaming devices to display information relating to the player's individual progress toward each one of the progressive awards and any bonus games. Since the controller tracks the individual progress toward each one of the progressive awards and any bonus games for each player in a player account, the gaming system enables players to move from gaming machine to gaming machine in the gaming system to play primary games of the players' choice. Tracking each player's individual progress toward each one of the progressive awards and any bonus games with the controller enables players to stop and resume play at a later time or during a different gaming session.

In one embodiment, the controller is programmed to operate with a plurality of different gaming machines in a server-based environment. In one such embodiment, a plurality of the gaming machines include a plurality of different primary games operable upon a wager placed by a player. Each of the different primary games can have different symbols or symbol combinations which can occur in a play of the primary game. The controller maintains a plurality of progressive awards and at least one bonus game. The controller associates symbols or symbol combinations from different primary games with one of the progressive awards or bonus games based on probability. For example, the controller determines that the symbol combination of a Royal Flush in a first primary game has a same or substantially similar probability of occurring as the symbol combination of A-A-A-A-A in a second primary game. In this example, the controller associates the symbol combinations of Royal Flush and A-A-A-A-A with a designated award (e.g., a first level progressive award, or a bonus game). In this embodiment, the controller tracks a quantity of the Royal Flush symbol combinations that occur in plays of the first primary game and tracks the A-A-A-A-A symbol combinations that occur in plays of the second primary game. When the tracked quantity of the Royal Flush symbol combinations and/or the A-A-A-A-A symbol combinations reach a designated level or quantity, the controller causes the designated award associated with the Royal Flush symbol combinations and/or the A-A-A-A-A symbol combinations to be provided. In this embodiment, the controller enables players at different gaming machines to each play for or try to win one or more progressive awards and bonus awards in plays of the same or different type of primary games.

In one embodiment, one or more progressive awards and/or bonus games are associated with different game events from different types of primary games. For example, a first progressive award is associated with a quantity of Royal Flush symbol combinations that can occur in plays of a first primary game and also associated with a quantity of A-A-A-A-A symbol combinations that can occur in plays of a second primary game. In this embodiment, to win the first progressive award, the player accumulates a quantity of Royal Flush symbol combinations in one or more plays of the first primary game and a quantity of A-A-A-A-A symbol combinations in one or more plays of the second primary game.

In one such embodiment, the different types of games are provided by the same gaming device. For example, the controller causes the gaming device to display a first primary game to enable the player to accumulate a quantity of Royal Flush symbol combinations in one or more plays of the first primary game. After the player achieves or accumulates a quantity of Royal Flush symbol combinations in one or more plays of the first primary game, the controller causes the gaming device to display the second primary game (e.g., automatically or after a suitable player input) to enable the player to accumulate a quantity of A-A-A-A-A symbol combinations in one or more plays of the second primary game.

In another such embodiment, the different types of games are provided by different gaming devices at the same or different geographical locations. For example, the controller causes a first gaming device to display a first primary game to enable the player to accumulate a quantity of Royal Flush symbol combinations in one or more plays of the first primary game. After the player achieves or accumulates a quantity of Royal Flush symbol combinations in one or more plays of the first primary game, the controller causes the first gaming device to display a location of a second gaming device at which the player can try to accumulate a quantity of A-A-A-A-A symbol combinations in one or more plays of a second primary game.

In one embodiment, one or more progressive awards and/or bonus games are associated with different game events from different denominations of primary games. For example, a first progressive award is associated with a first quantity of A-A-A-A-A symbol combinations that can occur in plays of a penny primary game, a second quantity of A-A-A-A-A symbol combinations that can occur in plays of a nickel primary game, and a third quantity of A-A-A-A-A symbol combinations that can occur in plays of a dollar primary game. In this embodiment, to win the first progressive award, the player accumulates the first, second, and third quantity of A-A-A-A-A symbol combinations at primary games of different denominations (e.g., penny, nickel, and dollar).

In one embodiment, the gaming system and method disclosed herein includes a point or count based system to provide one or more awards to one or more players in an equitable manner, regardless of what game or game type they are playing. The points or counts used in this gaming system are accumulated by the gaming system for a player (such as in a player account) based on one or more events associated with the player's gaming experience. For example, a designated game event such as an A-A-A-A-A symbol combination is associated with a designated number of points or counts.

The points or counts utilized in the gaming system are selectively redeemable by the player in exchange for one or more awards or opportunities to win an award on any gaming device enrolled in the gaming system disclosed herein. For example, a first progressive award is associated with a designated number of points or counts (e.g., 100 points). If each A-A-A-A-A symbol combination is associated with ten points or counts, a player has to accumulate ten A-A-A-A-A symbol combinations to be provided the first progressive award. It should be appreciated that in one embodiment, the points or counts disclosed herein are different, separate and independent from any monetary based points or credits, any promotional based points or credits, or any player tracking points. In other words, in this embodiment, the points or counts disclosed herein are not directly redeemable for direct currency and are further not associated with a player's point balance in a player's player tracking account.

In one embodiment, to account for the many different types of gaming devices in the gaming system providing different games with different parameters or characteristics, upon the occurrence of a point or count accumulation event, the gaming system utilizes one or more normalization equations to determine quantities of points or counts to provide to a player based on the player's specific wagering activity and the specific paytable associated with the player's currently played gaming device. In this embodiment, as the player may be playing at and thus utilizing any suitable paytable of any suitable gaming device in the gaming system, in determining an appropriate number of points or counts to provide to the player, the gaming system accounts for the paytable of the specific game played by the player, including the average expected payout of each game played. In other words, in one embodiment, the gaming system disclosed herein equates or normalizes the earning or distribution of points or counts to provide equality to players playing different games at different gaming devices which are associated with different paytables.

In one embodiment, the gaming system enables a player to redeem any accumulated points or counts in the player's account to win one or more progressive awards and/or bonus games. In this embodiment, if the player selects to cause a point or count redemption event to occur, the gaming system enables the player to selectively utilize their accumulated points or counts to determine what level and value of progressive award to provide to the player. In one such embodiment, to account for enabling the player to selectively be provided one or more of the different progressive awards associated with different suitable gaming devices of the gaming system, the gaming system determines the parameters of the available progressive awards based on the quantity of accumulated points or counts, the player's specific wagering activity and the specific paytable associated with the player's game. That is, since the player may select to play any suitable available game associated with the gaming system (and thus utilize the paytable of any suitable available game in the gaming system), in determining the quantity of points or counts which must be redeemed for each available game, the gaming system accounts for the paytable of the specific game selected by the player, including the average expected payout of each game played. In other words, the gaming system disclosed herein enables a player to play any suitable available game incorporating any suitable available features when they want and the amount of points or counts which must be redeemed for a play of such a game is determined accordingly. Such a configuration provides that the different gaming machines associated with different paytables of the gaming system are integrated via the points or counts disclosed herein.

In one embodiment, the controller is programmed to operate with a player tracking system to manage each player account. In one such embodiment, the player tracking system manages each player account and maintains any collected or accumulated quantities of designated game events for each player in the player accounts. That is, the player tracking system keeps track of each player's individual progress toward each one of the progressive awards and any bonus games. Players having a player tracking card or other suitable device can access the player tracking system through one of the gaming devices in the gaming system. This enables players to select any of the gaming machines in the gaming system to play for the progressive awards. Additionally, the gaming system enables each of the players to move from gaming machine to gaming machine to play primary games of the player's choice. In one embodiment, the controller and the player tracking system cooperate to maintain the player accounts, which enable players to stop and resume play at a later time or during a different gaming session.

In one embodiment, the controller sets the tracked quantities 112*a* and 112*b* for the player accounts associated with the first and second players (player A and player B) to a starting value (e.g., zero) and increments the tracked quantities from the starting value as each player collects or accumulates designated game events 106. In another embodiment, the controller sets the tracked quantities 112*a* and 112*b* for the player accounts associated with the first and second players (player A and player B) to starting values based on any suitable factor, such as a random determination or a status of a player (as determined through a suitable player tracking system).

For example, the first player (player A) is a platinum status player and the second player (player B) is a gold status player in a suitable player tracking system. In this example, the controller may adjust the tracked quantity 112*a* for one or more game events 106 in the player account associated with the first player (player A) based on the first player's platinum status. In one example, the controller starts the tracked quantity 112*a* of one or more game events 106 in the player account at one for the first player (player A) instead of zero for the second player (player B). By starting the tracked quantity 112*a* at a higher value (e.g., one) for one or more game events 106 in the player account, the controller reduces the quantity of game events which the first player (player A) must collect or accumulate before being provided one of the awards 100.

In another embodiment, the controller reduces the predetermined quantity for one or more of the game events 106 associated with one or more of the awards 100 based on the player's status. For example, instead of requiring a player to collect 5 A-A-A-A-A symbol combinations for the first level progressive award as described above, the controller enables a platinum status player to collect 4 A-A-A-A-A symbol combinations for the first level progressive award.

Figure 5:
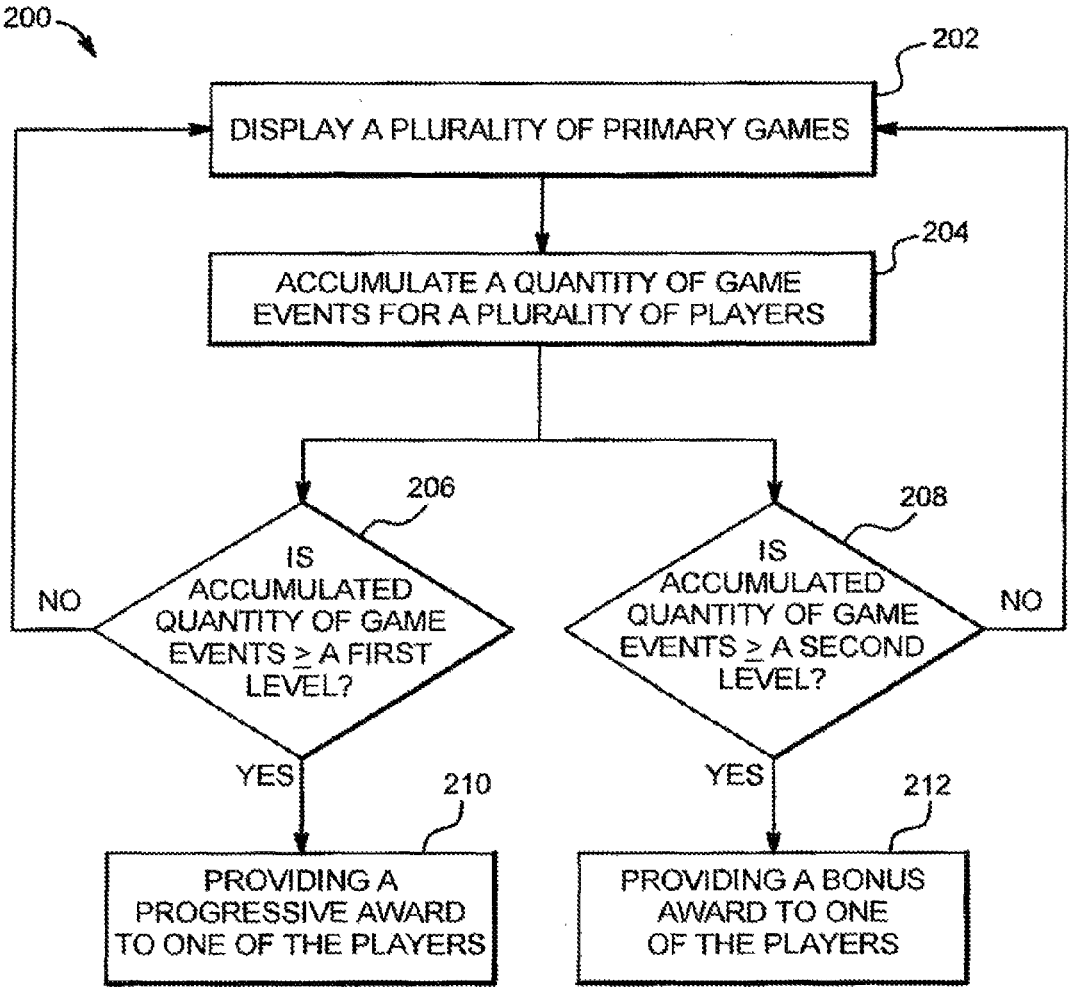
FIG. 5 is a flowchart of an example process for one embodiment of the gaming system and method disclosed herein, which simultaneously enables a plurality of players to each play for a plurality of progressive awards and a bonus game in plays of primary games.

Referring now to FIG. 5, a flowchart of an example process 200 for simultaneously enabling a plurality of players to each play for or try to win one or more progressive awards in plays of primary games displayable on system gaming machines is illustrated. In one embodiment, the process 200 is embodied in one or more software programs stored in one or more memories and executable by one or more processors, such as the controller of the gaming system. Although the process 200 is described with reference to the flowchart illustrated in FIG. 5, it should be appreciated that many other methods of performing the acts associated with process 200 may be used. For example, the order of many of the blocks may be changed, and many of the blocks described may be optional.

In one embodiment, the process 200 is embodied in computerized instructions executed by a controller or remote host. In such a "thin client" embodiment, the controller remotely controls any games (or other suitable interfaces) and the gaming device is utilized to display such games (or suitable interfaces) and receive one or more inputs or commands from a player. In another embodiment, the process 200 is embodied in computerized instructions which are communicated from the controller or remote host to a gaming device local processor and memory devices. In such a "thick client" embodiment, the gaming device local processor executes the communicated computerized instructions to control any games (or other suitable interfaces) provided to a player.

The process 200 enables a central controller to cause the system gaming machines to display a primary game after a player at one of those gaming machines places a wager, as indicated by block 202. The gaming system accumulates a quantity of game events, such as quantities of designated symbols or symbol combinations, for a plurality of players, as indicated by block 204. In one embodiment, the controller maintains individual player accounts for each of the players. In another embodiment, the controller operates in conjunction with a player tracking system to maintain such individual player accounts. The controller and/or the player tracking system accumulates each quantity of game events for each player in one of the player accounts.

With continued reference to FIG. 5, the controller operates with the gaming machines to determine whether the accumulated events reach: (i) a designated level or value associated with a progressive award, as indicated by decision diamond 206, or (ii) a designated level or value associated with a bonus award, as indicated by decision diamond 208. This determination may occur at substantially the same time (e.g., as one determination), or sequentially (e.g., as separate determinations). In one embodiment, the designated level includes different pluralities of the same game event for different progressive awards and/or bonus games. For example, if the accumulated events reach ten of the same game events, the controller provides a first progressive award to one of the players and if the accumulated events reach twenty of the same game events, the controller provides a bonus game to one of the players. In this embodiment, at least one progressive award and at least one bonus game are triggered by an accumulation of different quantities of the same game event.

If the accumulated events reach the designated level or value associated with a progressive award, the gaming system provides such progressive award to one of the players, as indicated by block 210. If the accumulated events do not reach the designated level or value associated with a progressive award, the gaming system enables another display of the primary game upon placement of a wager. The controller operates with the gaming machines to determine whether the accumulated events reach the designated level or value associated with a bonus award, as indicated by block 210. If the accumulated events reach the designated level or value associated with a bonus award, the gaming system provides such bonus award to one of the players, as indicated by block 212. If the accumulated events do not reach such a designated level, the gaming system enables another display of the primary game upon placement of a wager.

In one embodiment, the gaming system disclosed herein includes or is otherwise associated with a plurality of different progressive awards and/or independent progressive awards. In one embodiment, the different progressive awards are provided to a player based on an accumulated quantity of occurrences of different independent triggering events. In one embodiment, one or more progressive awards are each associated with a predetermined quantity of an outcome of a play of a primary game, such as a designated symbol combination. If the associated primary game outcome is generated, the quantity of such primary game outcome is accumulated in a player account. When the accumulated quantity in the player account reaches or exceeds the predetermined quantity associated with one of the progressive awards, such progressive award is provided.

Figure 6:
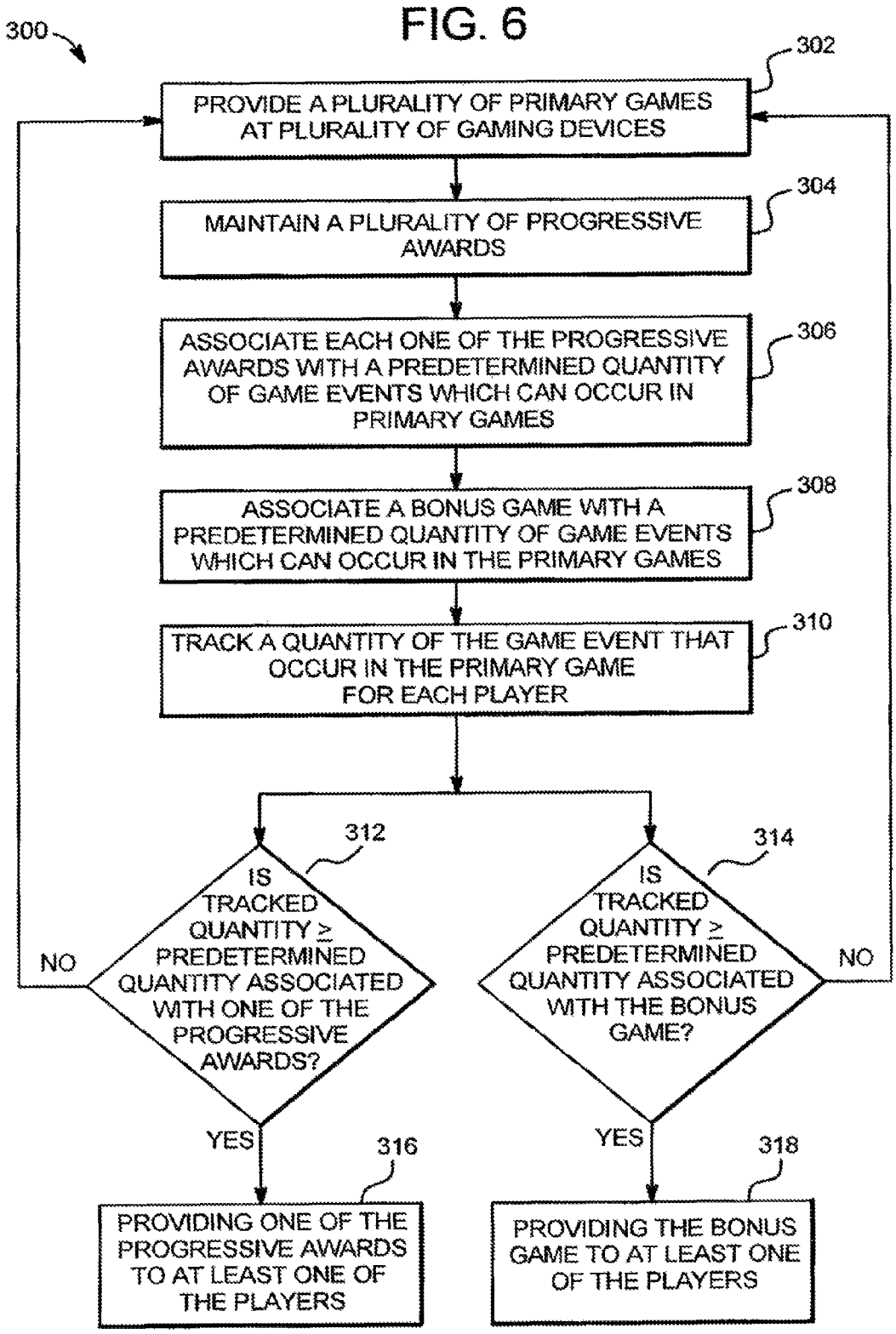
FIG. 6 is a flowchart of an example process for one embodiment of the gaming system and method disclosed herein, which simultaneously enables a plurality of players to each play for a plurality of progressive awards and a bonus game in plays of primary games.

Referring now to FIG. 6, a flowchart of an example process 300 for simultaneously enabling a plurality of players to each play for or try to win one or more progressive awards in plays of primary games displayable on system gaming machines is illustrated. In one embodiment, the process 300 is embodied in one or more software programs stored in one or more memories and executable by one or more processors, such as the controller of the gaming system. Although the process 300 is described with reference to the flowchart illustrated in FIG. 6, it should be appreciated that many other methods of performing the acts associated with process 300 may be used. For example, the order of many of the blocks may be changed, and many of the blocks described may be optional.

Generally, the process 300 enables the gaming system to associate each of a plurality of progressive awards (such as accumulated value progressive awards) and a bonus award (such as a bonus game) with separate triggering events in the same primary game. In this embodiment, one of the system gaming machines is configured to provide the bonus game and the controller is configured to maintain and provide the progressive awards.

As indicated by block 302, the controller of the gaming system causes each of the gaming machines to display a primary game after a player at one of those gaming machines places a wager. The controller maintains a plurality of progressive awards, as indicated by block 304. As indicated by block 306, each of a plurality of progressive awards are associated with separate triggering events. In one embodiment, the controller maintains the progressive awards in a MLP configuration with each level of the MLP associated with a separate triggering event. As indicated by block 308, a bonus award, such as a bonus game, is also associated with a triggering event.

In one embodiment, the triggering events are based on symbol driven events, such as one or more generations of a designated symbol or symbol combination in the primary games of the gaming machines of the gaming system. For example, the controller associates a first progressive award with a first triggering event, such as a first quantity of generations or occurrences of a designated symbol or symbol combination in the primary game for each player. The controller associates a second progressive award with a second, different triggering event, such as a second, different quantity of generations or occurrences of the same designated symbol or symbol combination in the primary game for each player. The controller associates a bonus award or a bonus game with a third, different triggering event, such as a third, different quantity of generations or occurrences of the same designated symbol or symbol combination in the primary game for each player. In this example, the first progressive award is associated with five generations or occurrences of the A-A-A-A-A symbol combination, the second progressive award is associated with ten generations or occurrences of the A-A-A-A-A symbol combination, and the bonus award or bonus game is associated with fifteen generations or occurrences of the A-A-A-A-A symbol combination. In one embodiment, the controller stores such associations in a memory device, such as memory device 14, operable with the controller.

In another example, the controller associates a first progressive award with a first triggering event, such as a quantity of generations or occurrences of a first designated symbol or symbol combination in the primary game for each player. The controller associates a second progressive award with a second, different triggering event, such as a quantity of generations or occurrences of a second, different designated symbol or symbol combination in the primary game for each player. The controller associates a bonus award or a bonus game with a third, different triggering event, such as a quantity of generations or occurrences of a third, different designated symbol or symbol combination in the primary game for each player. In this example, the first progressive award is associated with five generations or occurrences of the A-A-A-A-A symbol combination, the second progressive award is associated with five generations or occurrences of the B-B-B-B-B symbol combination, and the bonus award or bonus game is associated with five generations or occurrences of a bonus symbol (e.g., "BONUS"). It should be appreciated that each progressive award and bonus award, such as a bonus game, can be associated with (i) different predetermined quantities of a designated symbol or symbol combination which occur in the primary game, or (ii) a predetermined quantity of different designated symbols or symbol combinations which occur in the primary game. In one embodiment, the controller stores such associations in a memory device, such as memory device 14, operable with the controller.

In the process 300 illustrated in FIG. 6, the controller is programmed to track a quantity of the triggering events which occur in the primary games for a plurality of players, as indicated by block 310. In one embodiment, each triggering event includes a predetermined quantity of each generation of a designated symbol or symbol combination. In this embodiment, the controller accumulates the tracked quantities of each generation of a designated symbol or symbol combination for each player. For example, the first progressive award is associated with five generations or occurrences of the A-A-A-A-A symbol combination. In this example, the controller tracks the generations or occurrences of the A-A-A-A-A symbol combination in the primary game for each of the players. If a gaming machine being played by a first player generates the symbol combination of A-A-A-A-A, the controller tracks the generated symbol combination for the first player. If a gaming machine being played by a second player generates two symbol combinations of A-A-A-A-A, the controller tracks the generated symbol combinations for the second player. In this embodiment, the controller separately and individually tracks each occurrence or generation of a designated symbol combination which occurs during primary games for each player playing at one of the gaming machines in the gaming system.

In one embodiment, the controller accumulates the tracked quantities in an account associated with each of the players. In one embodiment, the controller stores such player accounts in a memory device, such as memory device 14, operable with the controller. In one embodiment, the account is part of, or is associated with, a player tracking account maintained by a suitable player tracking system.

For designated symbols or symbol combinations generated in the primary games (e.g., A-A-A-A-A), the controller determines whether the tracked quantity is equal to or greater than the predetermined quantity associated with one of the progressive awards, as indicated by decision diamond 312. The controller also determines whether the tracked quantity is equal to or greater than the predetermined quantity associated with the bonus award, as indicated by decision diamond 314. For example, the first progressive award is associated with five generations or occurrences of the A-A-A-A-A symbol combination. In this example, the five generations or occurrences are the predetermined quantity associated with the first progressive award. Once the gaming system tracks five generations or occurrences of the A-A-A-A-A symbol combination for one of the players, a triggering event will occur and the first progressive award will be provided to a player.

If the controller determines that the tracked quantity is equal to or greater than the predetermined quantity associated with one of the progressive awards, as indicated by decision diamond 312, the controller provides one of the progressive awards to at least one of the players, as indicated by block 316. In one embodiment, once one of the progressive awards is provided, the controller resets the provided progressive award to a reset value. If the tracked quantity is less than the predetermined quantity associated with one of the progressive awards, the controller enables a player to place another wager for the primary game.

In one embodiment, if the tracked quantity is greater than the predetermined quantity associated with one of the progressive awards, any remaining occurrences or generations of a designated symbol combination is rolled or carried over to a subsequent accumulation for the player. For example, if the tracked quantity is ten A-A-A-A-A symbol combinations and the predetermined quantity for a first progressive award is seven A-A-A-A-A symbol combinations, the controller provides the first progressive award to at least one of the players and carries the remaining three A-A-A-A-A symbol combinations to the next accumulation or tracked quantity for that player. In this example, the player has three A-A-A-A-A symbol combinations accumulated for the reset first progressive award.

If the controller determines that the tracked quantity is equal to or greater than the predetermined quantity associated with the bonus award, as indicated by decision diamond 314, the controller provides the bonus award to the player, as indicated by block 318. In one embodiment, the controller prompts the player for input whether or not to accept the bonus award. In one embodiment, the controller prompts the player for input whether to play a bonus game, or to save the bonus game. If the player selects to save the bonus award (e.g., selects to play the bonus game at a later time), the controller saves the bonus award to be provided to the player at a subsequent time.

If the controller determines that the tracked quantity is less than the predetermined quantity associated with one of the progressive awards, the controller enables a player to place another wager for the primary game.

In one embodiment, the controller offers the player an incentive to accumulate additional occurrences or generations of a designated game event It should be appreciated for the above embodiments that the quantity of designated symbols or symbols combinations associated with one progressive award or bonus game may differ from the quantity of designated symbols or symbols associated with another progressive award or bonus game. For example, a first progressive award is associated with five A-A-A-A-A symbol combinations and a second progressive award is associated with six A-A-A-A-A symbol combinations. Similarly, the designated symbols or symbol combinations associated with one of the progressive awards or bonus games may differ from the designated symbols or symbol combinations associated with another one of the progressive awards or bonus games. For example, a first progressive award is associated with five A-A-A-A-A symbol combinations and a second progressive award is associated with five B-B-B-B-B symbol combinations.

Referring now to FIGS. 7A to 7D, a display device 16 or 18 of one of the gaming machines in the gaming system is illustrated. The gaming machine provides a play of a primary game to a player upon placement of a wager. It should be appreciated that this embodiment is described as it relates to one gaming machine in the gaming system. The gaming system disclosed herein enables a plurality of such gaming machines to provide a plurality of primary games to a plurality of players.

The display device 16 or 18 of the gaming device displays one play of a primary game. In this example, the primary game includes a plurality of reels 54, one or more paylines 52 associated with the reels 54, and a plurality of symbols 400. It should be appreciated that the primary game can include any suitable game, such as a card game. The symbols 400, in this example, are represented by the letters A, B, C, D, E, BONUS, RE-TRIGGER, AND WILD displayed on the reels 54. It should be appreciated that the symbols can include any suitable character, numeral, indicia or image.

Figure 7A:
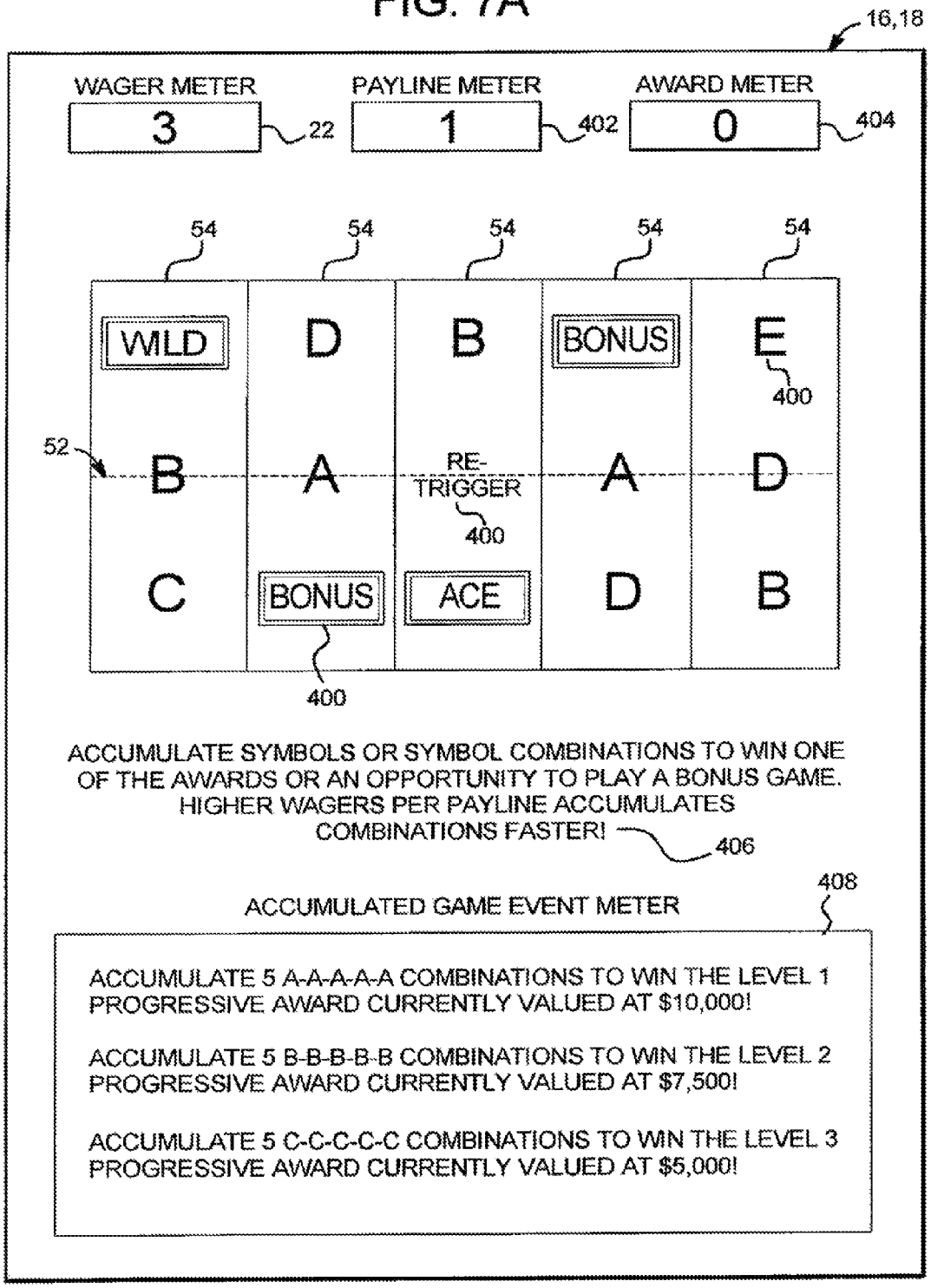

The display device 16 or 18 displays a bet display 22, such as a wager meter, to indicate a number of monetary units wagered on a play of the primary game at the gaming device. The display device 16 or 18 also displays a payline meter 402 to indicate the number of paylines wagered on the play of the primary game at the gaming device. As seen in FIG. 7A, the wager meter 22 indicates three monetary units and the payline meter 402 indicates one payline. The display device 16 or 18 also displays an award meter 404 which indicates any award provided for the play of the primary game.

As seen in FIG. 7A, the display device 16 or 18 includes a display area 406, which in this example, displays a message such as "ACCUMULATE SYMBOL COMBINATIONS TO WIN ONE OF THE AWARDS OR AN OPPORTUNITY TO PLAY A BONUS GAME. HIGHER WAGERS PER PAYLINE ACCUMULATES COMBINATIONS FASTER!" Such messages may be provided to the player visually, or through suitable audio or audiovisual displays. In this embodiment, the controller enables the player of the gaming device to accumulate designated game events through one or more plays of the primary game. If the player accumulates a predetermined quantity of the game events, the controller will provide the player with a progressive award or the bonus game.

Referring now to FIGS. 7A and 7B, the controller of the gaming system cooperates with the display device 16 or 18 so as to cause the display device 16 or 18 to display an accumulated game event meter 408. The accumulated game event meter 408 displays or indicates information relating to at least one, a plurality of, or all of the progressive awards and/or bonus games available for the player to win during plays of the primary game. As seen in FIG. 7A, the accumulated game event meter 408 indicates information relating to a first level progressive award, a second level progressive award, and a third level progressive award. In one embodiment, the controller of the gaming system causes the accumulated game event meter 408 to display information relating to each progressive award and each bonus game offered in the primary game.

In one embodiment, the accumulated game event meter 408 displays an award identification, an award value and/or a predetermined requirement for the player to win the identified award. As each progressive award increments or increases, the controller communicates with the accumulated game event meter 408 to cause the accumulated game event meter 408 to indicate or display such progressive award increments and increases. For the first level progressive award, in this example, the accumulated game event meter 408 displays an appropriate message such as "ACCUMULATE 5 A-A-A-A-A COMBINATIONS TO WIN THE LEVEL 1 PROGRESSIVE AWARD CURRENTLY VALUED AT $10,040!" Such messages may be provided to the player visually, or through suitable audio or audiovisual displays. As seen in FIG. 7B, the controller may control the accumulated game event meter 408 to display such information relating to one, a plurality of, or all of the progressive awards and/or bonus games available for the player to win during plays of the primary game.

The controller communicates via messages or signals with the gaming device to update the accumulated game event meter 408 with information relating to the progressive awards and any bonus games. For example, the controller monitors the player accounts associated with each player at each gaming machine in the gaming system. The controller communicates information from respective player accounts to a corresponding gaming machine so that each accumulated game event meter 408 displayed by the display device 16 or 18 of each gaming machine displays current or updated information relating to each of the player's progress toward the progressive award and any bonus games.

Figure 7C:
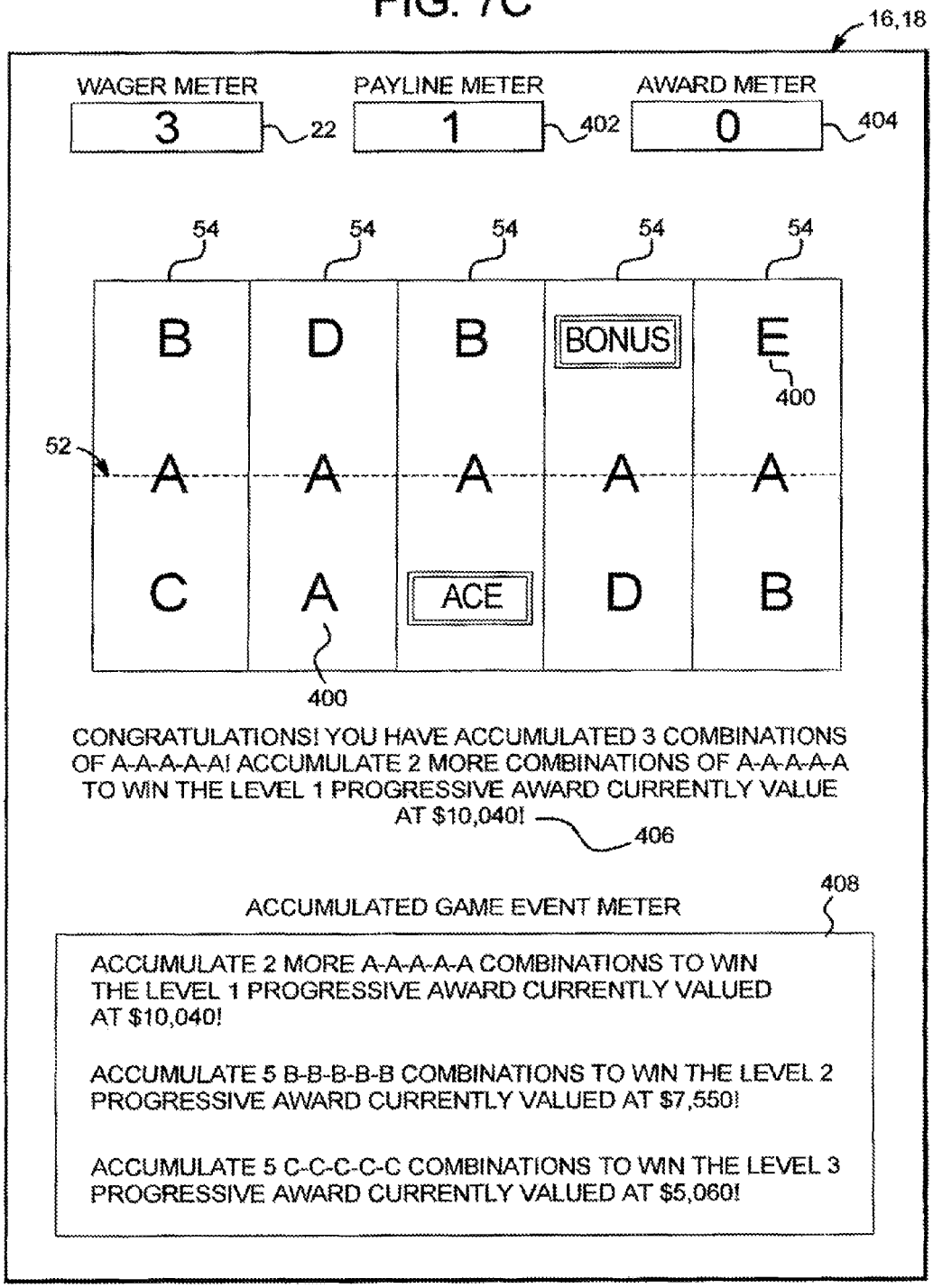

Referring now to FIG. 7C, the display device 16 or 18 displays another play of the primary game. In this play, the gaming device generated an occurrence of an A-A-A-A-A symbol combination on the reels 54 along the payline 52. For this play of the primary game, the wager meter 22 and the payline meter 402 indicate that the player wagered three monetary units on one payline. That is, the player wagered three monetary units per payline. In one embodiment of the gaming system, the controller tracks or counts each occurrence of a designated symbol or symbol combination as a multiple of each player's wager per payline in plays of the primary game. As seen in FIG. 7C, the controller counts the A-A-A-A-A symbol combination as three occurrences based on the player's wager per payline.

In one embodiment, the controller tracks or accumulates the quantity of the A-A-A-A-A symbol combinations. In one embodiment, the controller stores the tracked or accumulated quantities in separate player accounts for each of the players. In one embodiment, the controller messages or signals the gaming device to update the accumulated game event meter 408 based on information from the player accounts relating to the progressive awards and any bonus games. In another embodiment, the controller causes the display device 16 or 18 to display such information.

The message display area 406 displays a message such as "CONGRATULATIONS! YOU HAVE ACCUMULATED 3 COMBINATIONS OF A-A-A-A-A! ACCUMULATE 2 MORE COMBINATIONS OF A-A-A-A-A TO WIN THE LEVEL 1 PROGRESSIVE AWARD CURRENTLY VALUED AT $10,040!" In this example, the controller informs the player of: (1) the player's progress toward the one of the progressive awards and bonus games, and (2) the current value of one or more of the progressive awards. The accumulated game event meter 408 indicates that the player of the gaming machine must accumulate two more A-A-A-A-A combinations to win the first level progressive award.

As seen in FIG. 7C, the message display area 406 and the accumulated game event meter 408 display overlapping information. In another embodiment, the message display area 406 and the accumulated game event meter 408 display different information. It should be appreciated that the controller communicates with the message display area 406 and/or the accumulated game event meter 408 and instructs what content to display, where to display such content, how to display such content and for how long to display such content. In one embodiment, the accumulated game event meter 408 displays the current values of the progressive awards the gaming machine is currently connected to or associated with. It should be further appreciated that such information can be provided to the players through any suitable audio, audio-visual or visual devices.

Figure 7D:
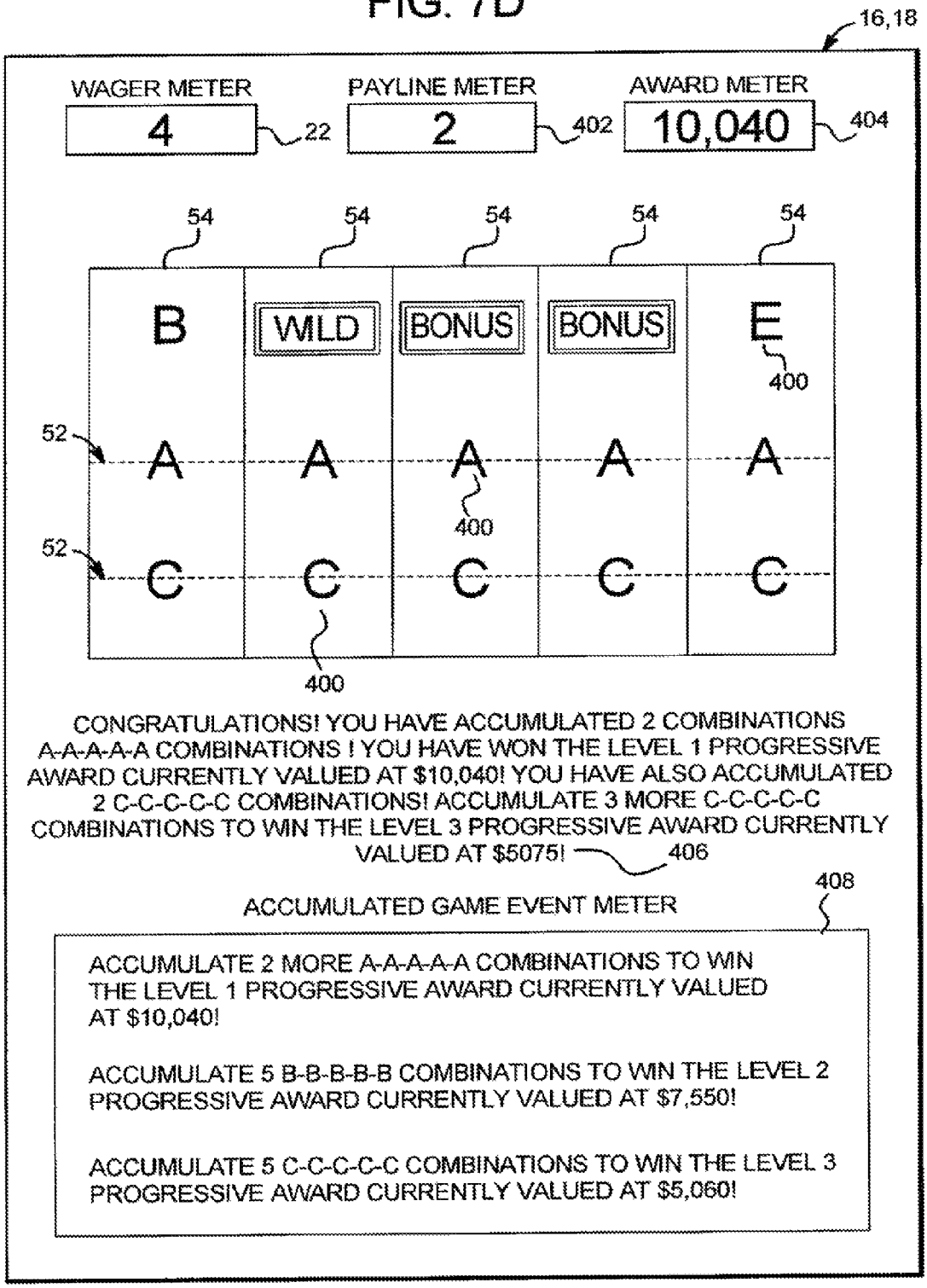

Referring now to FIG. 7D, the display device 16 or 18 displays another play of the primary game. In this play, the gaming device generated an occurrence of an A-A-A-A-A symbol combination on the reels 54 along one payline 52 and generated an occurrence of a C-C-C-C-C symbol combination on the reels 54 along another payline 52. For this play of the primary game, the wager meter 22 and the payline meter 402 indicate that the player wagered four monetary units on two paylines. That is, the player wagered two monetary units per payline. In one embodiment of the gaming system, the controller tracks or counts each occurrence of a designated symbol or symbol combination as a multiple of each player's wager per payline in plays of the primary game. As seen in FIG. 7D, the controller counts each of the A-A-A-A-A and the C-C-C-C-C symbol combinations as two occurrences based on the player's wager per payline.

In one embodiment, the controller tracks or accumulates the quantity of the A-A-A-A-A and C-C-C-C-C symbol combinations. As seen in FIG. 7D, the player has accumulated the predetermined requirement (e.g., five occurrences) associated with the symbol combination A-A-A-A-A. The controller causes the gaming machine to provide the first level progressive award valued at $10,040 to the player. The controller resets the provided progressive award to its initial value (e.g., $10,000).

Since five occurrences of A-A-A-A-A is the threshold number of game events which must be reached for the player to win the first level progressive award and the player's five accumulated game events meets or exceeds this threshold, the player is provided the first level progressive award. As seen in FIG. 7D, the award meter 404 indicates that the player won $10,040 monetary units for the first level progressive award.

The message display area 406 displays appropriate messages such as "CONGRATULATIONS! YOU HAVE ACCUMULATED 2 A-A-A-A-A COMBINATIONS! YOU HAVE WON THE LEVEL 1 PROGRESSIVE AWARD CURRENTLY VALUED AT $10,040!" and "YOU HAVE ALSO ACCUMULATED 2 C-C-C-C-C COMBINATIONS! ACCUMULATE 3 MORE C-C-C-C-C COMBINATIONS TO WIN THE LEVEL 3 PROGRESSIVE AWARD CURRENTLY VALUED AT $5075!" These messages may be provided to the player visually, or through suitable audio or audiovisual displays.

The accumulated game event meter 408 displays information relating to the first level progressive award, which was reset to its initial value in this example. Such information can be communicated or provided to the player visually, or through suitable audio or audiovisual displays. As seen in FIG. 7D, the accumulated game event meter 408 displays an appropriate message such as "ACCUMULATE 5 A-A-A-A-A COMBINATIONS TO WIN THE LEVEL 1 PROGRESSIVE AWARD CURRENTLY VALUED AT $10,000!"

Figure 8A:
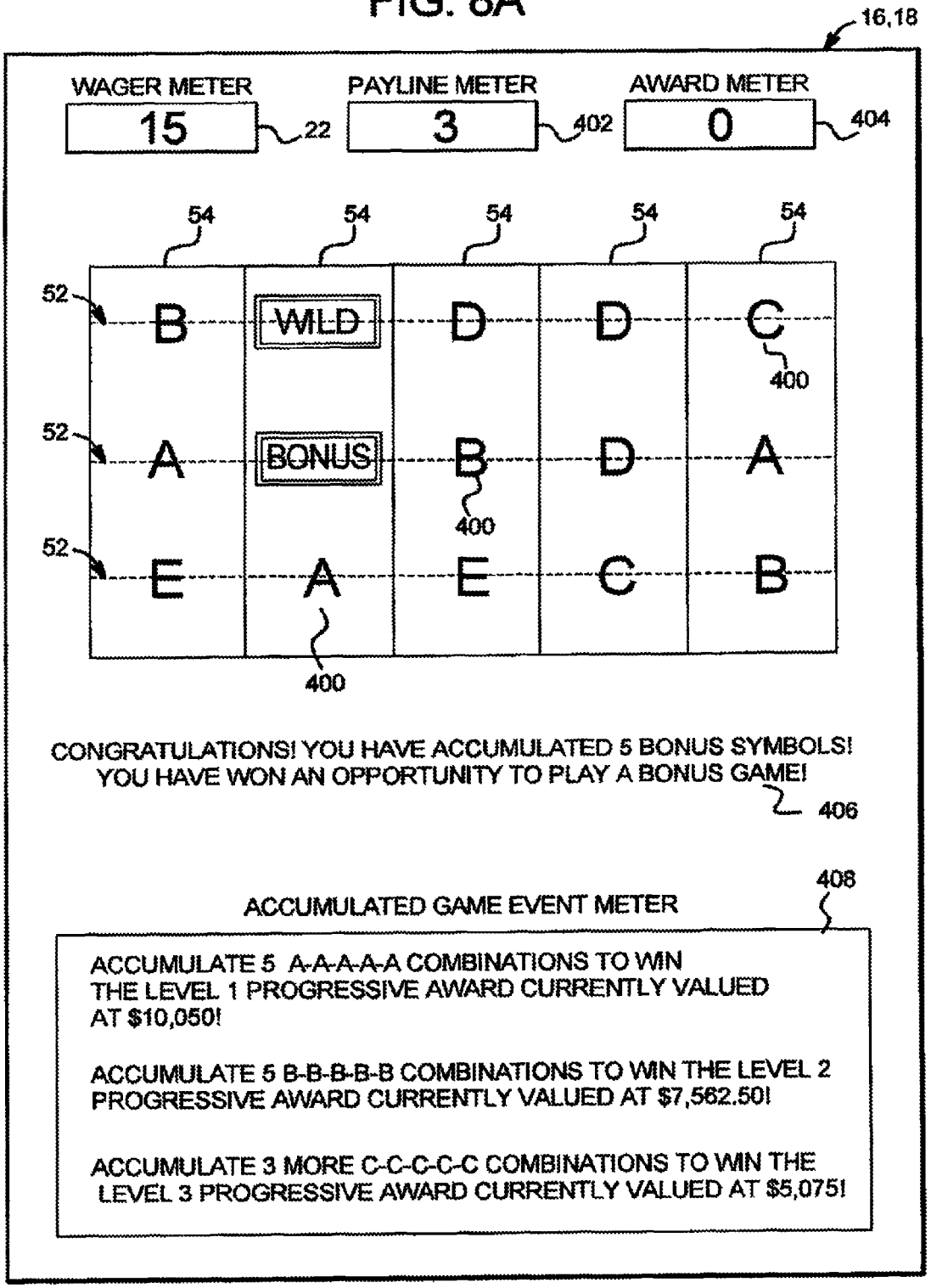
FIGS. 8A and 8B are top plan views of a display device of one of the gaming devices of one embodiment of the gaming system disclosed herein illustrating another example play for one player of a primary game at one gaming machine in the gaming system.
Figure 8B:
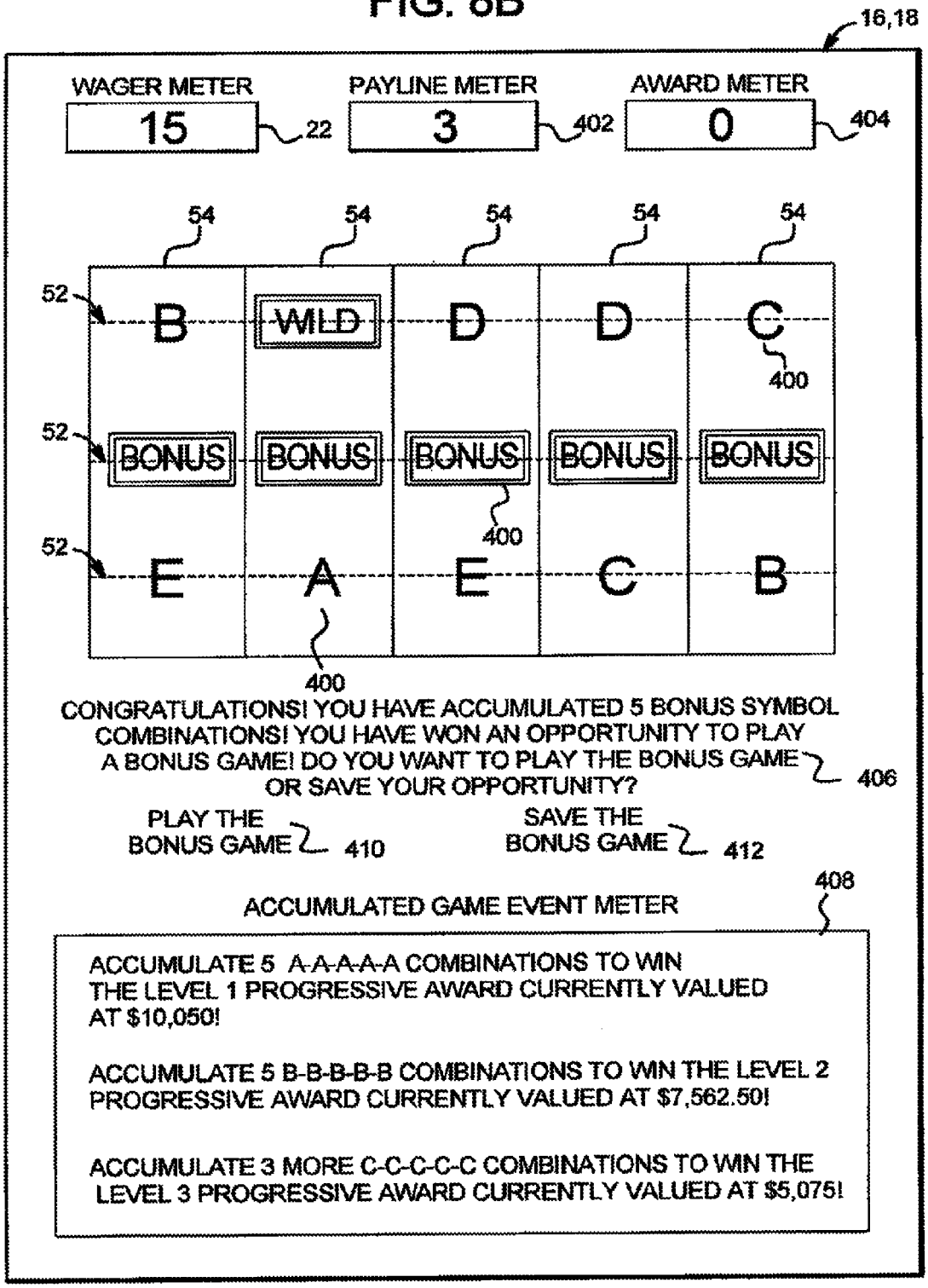

Referring now to FIGS. 8A and 8B, a display device 16 or 18 of one of the gaming machines in the gaming system is illustrated. The gaming machine provides a play of a primary game to a player upon placement of a wager. It should be appreciated that this embodiment is described as it relates to one gaming machine in the gaming system. The gaming system disclosed herein enables a plurality of such gaming machines to provide a plurality of primary games to a plurality of players.

The display device 16 or 18 displays a play of the primary game. In this play, the gaming device generated an occurrence of an A-BONUS-B-D-A symbol combination on the reels 54 along the payline 52. For this play of the primary game, the wager meter 22 and the payline meter 402 indicate that the player wagered fifteen monetary units on three paylines. That is, the player wagered five monetary units per payline. In one embodiment of the gaming system, the controller tracks or counts each occurrence of a designated symbol or symbol combination as a multiple of each player's wager per payline in plays of the primary game. As seen in FIG. 8A, the controller counts the single occurrence of the BONUS symbol as five occurrences based on the player's wager per payline of five monetary units.

Since five occurrences of the BONUS symbol is the threshold number of game events which must be reached for the player to win an opportunity to play a bonus game and the player's five accumulated bonus symbols meets or exceeds this threshold, the player is provided an opportunity to play the bonus game. In one embodiment, the gaming machine provides the bonus game to the player. In another embodiment, the controller cooperates with the gaming machine processor to provide the bonus game to the player. As seen in FIG. 7D, the message display area 406 displays appropriate messages such as "CONGRATULATIONS! YOU HAVE WON AN OPPORTUNITY TO PLAY A BONUS GAME!" This message may be provided to the player visually, or through suitable audio or audiovisual displays.

Referring now to FIG. 8B, the gaming system disclosed herein enables a player to selectively play the bonus game. That is, the controller and/or the gaming machine processor request input from the player regarding whether or not the player wants to play the bonus game, or save the bonus game. Such request may be provided to the player visually, or through suitable audio or audiovisual displays. In one embodiment, the display device 16 or 18 displays a selectable icons 410 and 412 including messages such as "PLAY THE BONUS GAME" AND "SAVE THE BONUS GAME." In one embodiment, the selectable icons include touch screen elements. If the player selects to play the bonus game, the controller and/or the gaming machine processor provide the bonus game to the player as requested by that player. If the player selects to save the bonus game, the controller maintains the tracked quantity of bonus symbols in the player's account.

In one embodiment, the gaming system includes a multi-level award structure in association with a plurality of primary games, wherein the primary games can be the same primary game or different primary games. In one embodiment, a plurality of gaming machines offer different primary games to players. In this embodiment, the different primary games include different symbols. To monitor such primary games, the gaming system disclosed herein adds to, or otherwise changes, the symbol set associated with each primary game.

In one embodiment, the controller associates a uniform symbol set, such as a plurality of sub-symbols, with the different symbols of the primary games. In one embodiment, the gaming system implements the uniform symbol set across all of the primary games at the system gaming machines. In one embodiment, the uniform symbol set associates designated symbols in each of the primary games with a number of secondary symbol characteristics, such as a sub-symbol. That is, the controller associates each primary game with a set of sub-symbols, from which sub-symbols or combinations of such sub-symbols must be accumulated to provide one of the players with one of the progressive awards or the bonus game. For example, a first progressive award is associated with five occurrences of the A-A-A-A-A sub-symbol combination and a second progressive award is associated with five occurrences of the B-B-B-B-B sub-symbol combination. If a first primary game generates an outcome of $7_A$-$\text{Bell}_A$-$\text{Bell}_A$-$\text{Bar}_A$-$\text{Lemon}_A$ on a payline wagered on by a first player, the controller accumulates the sub-symbol combination A-A-A-A-A in that first player's account. Similarly, if a second, different primary game generates an outcome of $\text{Cherry}_A$-$\text{Bell}_A$-$\text{Bar}_A$-$\text{Cherry}_A$-$\text{Blank}_A$ on a payline wagered on by a second player, the controller accumulates the sub-symbol combination A-A-A-A-A in that second player's account. In this example, both the first and second players accumulated the sub-symbol combination A-A-A-A-A during the primary game. If one of the players accumulates the sub-symbol combination A-A-A-A-A five times during one or more plays of the primary game, the player is provided the first level progressive award. In this example, the controller tracks and accumulates the sub-symbols in player accounts associated with each one of the players.

Figure 9A:
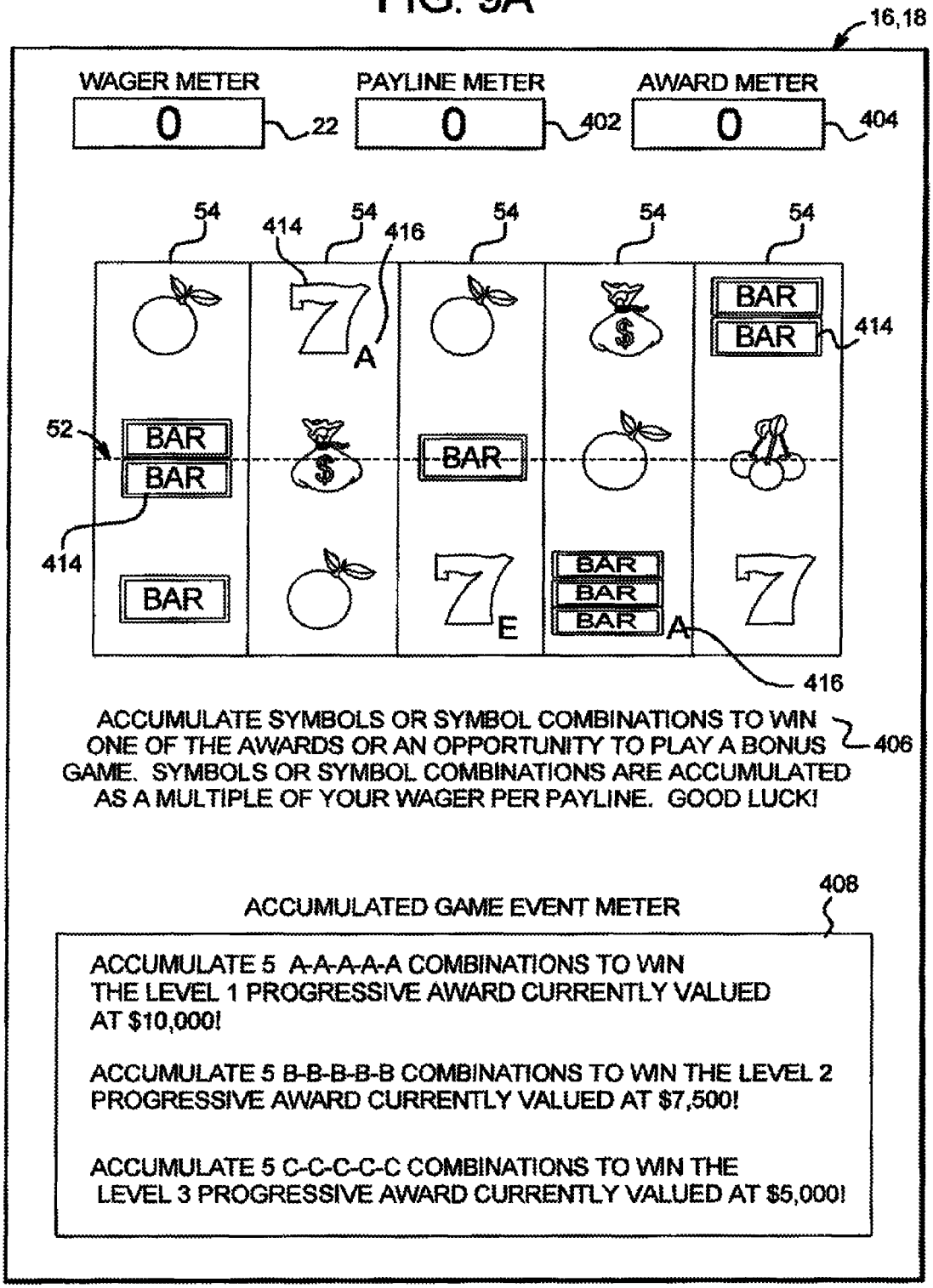
FIGS. 9A and 9B are top plan views of a display device of one of the gaming devices of one embodiment of the gaming system disclosed herein illustrating another example play for one player of a primary game at one gaming machine in the gaming system.
Figure 9B:
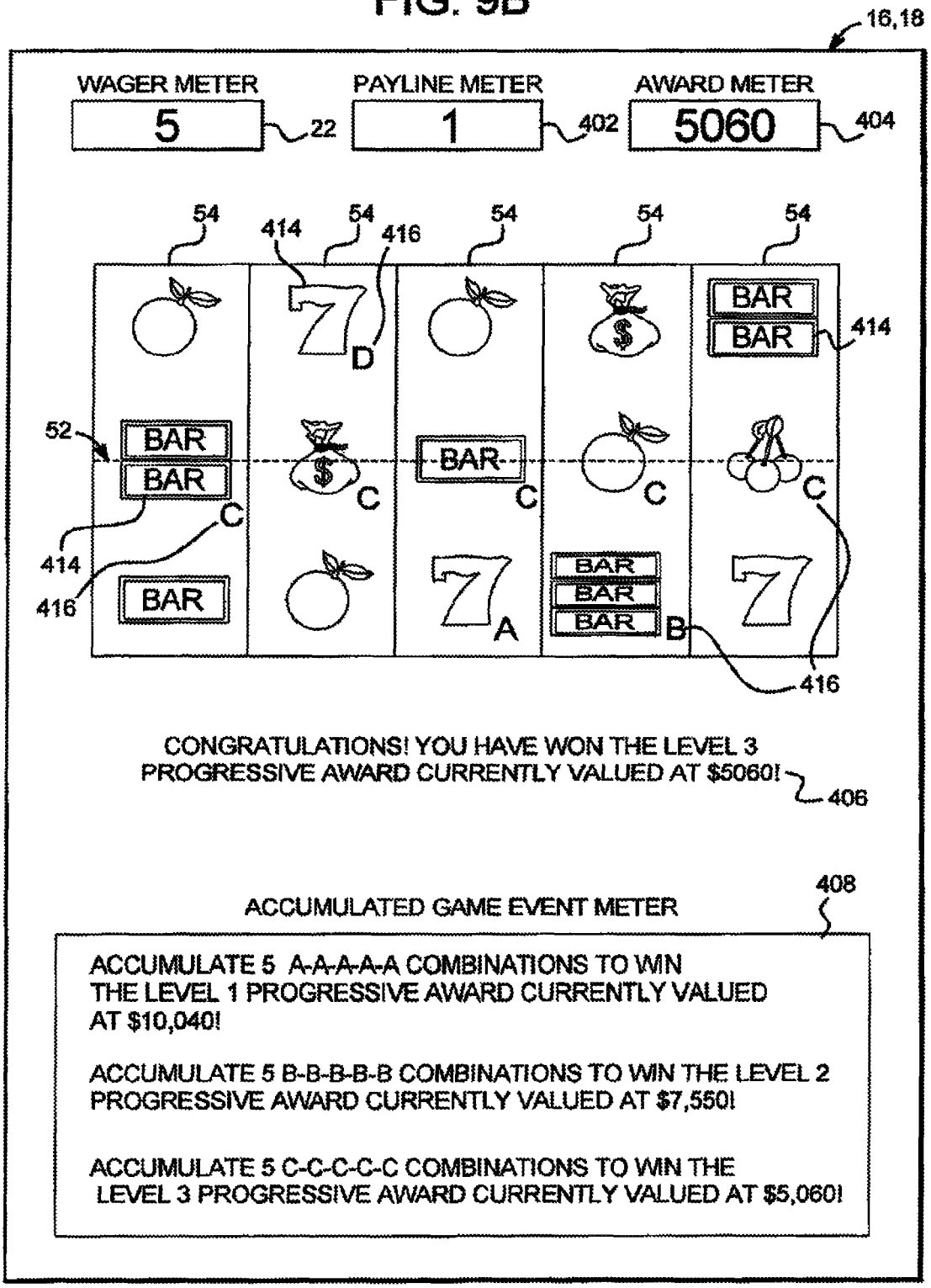

Referring now to FIGS. 9A and 9B, the display device 16 or 18 of the gaming device displays a primary game. In this example, the primary game includes a plurality of reels 54, one or more paylines 52 associated with the reels 54, and a plurality of symbols 414 and 416. Symbols 414 are primary game symbols, which may be the same or different as other primary games in the gaming system. Symbols 416 are sub-symbols, which are from a uniform symbol set in this example. The sub-symbols 416 are uniform across each of the primary games. It should be appreciated that the primary game can include any suitable game, such as a card game. The symbols 414, in this example, are represented by the icons of a BAR, DOUBLE BAR, ORANGE, SEVEN, CHERRY, AND MONEY BAG displayed on the reels 54. The sub-symbols 416, in this example, are represented as letters, such as A, B, C, D, and E. It should be appreciated that the symbols 414 and 416 can include any suitable character, numeral, indicia or image.

In this embodiment, the controller enables the player of the gaming device to accumulate designated game events (e.g., combinations of sub-symbols 416) through one or more plays of the primary game. If the player accumulates a predetermined quantity of the game events, the controller will provide the player with a progressive award or the bonus game. The gaming system enables each player to accumulate combinations of sub-symbols 416.

As seen in FIG. 9A, the display device 16 or 18 displays the reels 54 with a plurality of symbols 414 along the payline 52 and a plurality of symbols 416 in a scatter arrangement on the reels 54. When a player places a wager on the gaming device, the gaming device generates a plurality of symbols on the reels 54. As seen in FIG. 9B, the gaming device generated an occurrence of a C-C-C-C-C sub-symbol combination on the reels 54 along the payline 52. Each symbol generation on the reels 54 may include zero, one or a plurality of the sub-symbols 416.

The award meter 404 indicates that the player won 5060 monetary units for the third level progressive award. The message display area 406 may provide appropriate messaging, such as "CONGRATULATIONS! YOU HAVE WON THE LEVEL 3 PROGRESSIVE AWARD CURRENTLY VALUED AT $5060!" This message may be provided to the player visually, or through suitable audio or audiovisual displays.

Play of the primary game ends when the player ends his or her gaming session. The controller determines when the player ends his or her gaming session in any suitable manner. For example, the player's gaming session ends when the controller determines that the player cashes out or when the controller determines that the player's player tracking card has been removed from one of the gaming machines. The controller determination may be based on any suitable factor, such as time or wager activity by the player.

In one embodiment, the gaming system associates a number of points with each progressive award and bonus award, such as a bonus game. In one such embodiment, the controller and/or the gaming machines track and accumulate a number of points associated with each progressive award and bonus award. When the accumulated number of points for one of the progressive awards or the bonus awards reaches a designated level, that progressive award or bonus award is provided to one of the players. For example, a first level progressive award is associated with five points and each occurrence of the A-A-A-A-A symbol combination in the primary game counts as one point toward the first level progressive award. In this example, once one of the players accumulates five points (e.g., either by wagering five credits per payline in the primary game in which the A-A-A-A-A symbol combination occurs one time, or by wagering one credit per payline in the primary game in which the A-A-A-A-A symbol combination occurs five times), that player is provided the first level progressive award.

In such embodiments, it should be appreciated that each progressive award and bonus award, such as a bonus game, can be associated with (i) different predetermined quantities of points for a designated symbol or symbol combination which can occur in the primary game, or (ii) a predetermined quantity of points for different designated symbols or symbol combinations which can occur in the primary game.

In one embodiment, the gaming system associates a range of points or occurrences of a designated symbol or symbol combination with each progressive award or bonus award. In one such embodiment, each point corresponds to one occurrence of a designated symbol or symbol combination. For example, the controller associates a range of 400 to 600 points with the symbol combination A-A-A-A-A. The symbol combination A-A-A-A-A is associated with a first level progressive award. In one embodiment, the controller randomly selects a triggering value from the associated range. In other embodiments, the controller selects a triggering value from the associated range based on different factors, such as wager amount, player status (as determined by a suitable player tracking system), time, or any other suitable factor. For example, the controller selects a triggering value of 520 points and communicates this triggering value to the gaming machines. The gaming machines track the number of points accumulated in plays of the primary games. In this example, once one of the gaming machines accumulates 520 points associated with the A-A-A-A-A combination, that gaming machine communicates to the controller that the first level progressive award has been won by a player. The controller determines the value of the first level progressive award, such as $10,050, and causes the gaming machine to provide the first level progressive award to the player. The controller resets the first level progressive award after that award is provided to the player.

In such embodiments, it should be appreciated that each progressive award and bonus award, such as a bonus game, can be associated with (i) different predetermined ranges of points for a designated symbol or symbol combination which can occur in the primary game, (ii) a predetermined range for different designated symbols or symbol combinations which can occur in the primary game, or (iii) different triggering vales selected by the controller in different ways, such as randomly or based on a suitable factor.

In one embodiment, the gaming system includes a supplemental progressive award which is separate from the multi-level configuration described herein. Such supplemental progressive awards are triggered upon a progressive triggering event or qualifying condition other than symbol-driven events. Additionally, such supplemental progressive awards independent of the primary games. In different embodiments, the progressive award triggering event or qualifying condition associated with such supplemental progressive awards may be by exceeding a certain amount of game play (such as number of games, number of credits, or amount of time), or reaching a specified number of points earned during game play. In another embodiment, a gaming device is randomly or apparently randomly selected to provide a player of that gaming device one or more supplemental progressive awards. In one such embodiment, the gaming device does not provide any apparent reasons to the player for winning a supplemental progressive award, wherein winning the supplemental progressive award is not triggered by an event in or based specifically on any of the plays of any primary game. That is, a player is provided a progressive award without any explanation or alternatively with simple explanations.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one central controller; and a plurality of gaming machines, each gaming machine operable under control of at least one gaming machine processor and configured to communicate with the at least one central controller, each of the gaming machines including:

a housing, at least one display device supported by the housing, a plurality of input devices supported by the housing, said plurality of input devices including:

(i) an acceptor, and (ii) a cashout device, and at least one memory device which stores a plurality of instructions executable by the at least one gaming machine processor to cause the at least one gaming machine processor to operate with the at least one display device, and the plurality of input devices to:

(i) if a physical item is received via the acceptor, establish a credit balance based, at least in part, on a monetary value associated with the received physical item, (ii) after establishing the credit balance based, at least in part, on the monetary value associated with the received physical item:

(A) upon a placement of a wager on a play of a primary game, randomly generate a symbol outcome for the play of the primary game, (B) modify the credit balance based on at least one of:

(I) the wager placed on the play of the primary game, and (II) any award associated with the randomly generated symbol outcome for the play of the primary game and (C) if a triggering event occurs in association with the play of the primary game, display a play of a secondary game, (D) modify the credit balance based on any award associated with the play of the secondary game, and (iii) if a cashout input is received via the cashout device, cause an initiation of any payout associated with the credit balance;

wherein the at least one central controller is programmed to operate with the at least one gaming machine processor of each gaming machine to:

(a) maintain a plurality of progressive awards, (b) if the randomly generated symbol outcome of any of the plays of any of the primary games of any of the gaming machines includes at least one designated symbol outcome, accumulate a quantity of said designated symbol outcomes, (c) determine whether to provide one of the progressive awards, the determination being based on any of the randomly generated symbol outcomes being at least one of the designated symbol outcomes and the quantities of the designated symbol outcomes accumulated, (d) in response to the determination being to provide one of the progressive awards, cause one of the gaming machines to provide the progressive award to a player of said gaming machine.

2. The gaming system of claim 1, wherein the controller is configured to operate with the gaming machines to:

(a) associate a tracking account with each player of each of the gaming machines, (b) determine whether any of the gaming machines generated one of the designated symbol outcomes, and (c) for each player of each gaming machine which generated at least one of the designated symbol outcomes, accumulate the quantities of said designated symbol outcomes in the tracking account associated with said player.

3. The gaming system of claim 2, wherein the quantities of designated symbol outcomes are accumulated in the tracking account associated with at least the player of the gaming machine which generated the designated symbol outcome.

4. The gaming system of claim 1, wherein the controller associates at least one of the designated symbol outcomes with a bonus game and upon an occurrence of a designated quantity of the designated symbol outcome associated with the bonus game in the primary game, the controller is configured to operate with at least one of the gaming machines to cause a display of the bonus game.

5. The gaming system of claim 1, wherein each progressive award is associated with a different designated symbol outcome.

6. The gaming system of claim 1, wherein each progressive award is associated with a different quantity of the same or related designated symbol outcome.

7. The gaming system of claim 1, wherein each progressive award is associated with a different designated symbol outcome and a quantity of said designated symbol outcome.

8. The gaming system of claim 1, wherein the controller is configured to operate with the gaming machines to accumulate a quantity of said designated symbol outcomes at a first of the gaming machines located at a first location and to accumulate a quantity of said designated symbol outcomes at a second of the gaming machines located at a second location.

* * * * *